US011097287B2

(12) United States Patent
Takano

(10) Patent No.: US 11,097,287 B2
(45) Date of Patent: Aug. 24, 2021

(54) DEVICE FOR GENERATING PULSATILE FLOW OR INTERMITTENT FLOW

(71) Applicant: Masaaki Takano, Osaka (JP)

(72) Inventor: Masaaki Takano, Osaka (JP)

( * ) Notice: Subject to any disclaimer, the term of this patent is extended or adjusted under 35 U.S.C. 154(b) by 14 days.

(21) Appl. No.: 15/748,917

(22) PCT Filed: Jun. 29, 2016

(86) PCT No.: PCT/JP2016/069300

§ 371 (c)(1),
(2) Date: Mar. 20, 2018

(87) PCT Pub. No.: WO2017/018119

PCT Pub. Date: Feb. 2, 2017

(65) Prior Publication Data

US 2019/0009283 A1 Jan. 10, 2019

(30) Foreign Application Priority Data

Jul. 30, 2015 (JP) ..... JP2015-150970

(51) Int. Cl.

| | |
|---|---|
| ***B05B 1/08*** | (2006.01) |
| ***B05B 12/06*** | (2006.01) |
| ***B08B 3/02*** | (2006.01) |
| ***E03C 1/084*** | (2006.01) |
| ***B05B 7/04*** | (2006.01) |
| *A61H 33/02* | (2006.01) |

(52) U.S. Cl.

CPC ..... *B05B 1/08* (2013.01); *B05B 7/0425* (2013.01); *B05B 12/06* (2013.01); *B08B 3/02* (2013.01);

(Continued)

(58) Field of Classification Search

CPC ..... B05B 1/08; B05B 7/0425; B05B 12/06; B05B 3/02; E03C 1/084; A61H 2033/022

(Continued)

(56) References Cited

U.S. PATENT DOCUMENTS 3,801,019 A 4/1974 Trenary et al.
4,484,710 A * 11/1984 Roznieck ..... A62C 31/00 239/290

(Continued)

FOREIGN PATENT DOCUMENTS

DE 10008438 8/2001
JP 50-50162 A 5/1975

(Continued)

OTHER PUBLICATIONS

International Search Report and Written Opinion, International Application No. PCT/JP2016/069300, dated Sep. 20, 2016, with English translation of Search Report (11 pages).

*Primary Examiner* — Chee-Chong Lee
(74) *Attorney, Agent, or Firm* — Hamre, Schumann, Mueller & Larson, P.C.

(57) ABSTRACT

The present invention provides a device that can generate a pulsatile flow or intermittent flow from a continuously flowing of the water tap by pressure of the water tap without using an electrical activation part. The device for generating a pulsatile fluid or intermittent fluid comprises an injection mechanism 110 for injecting fluid, which is a liquid or gas; an air cavity 120 which includes an airtight space, a draining portion 150 disposed in the lower part; an air intake ventilation hole 141 connected to the ventilation pass 140. The injection point of the injection mechanism 110 is around the air intake ventilation hole 141, and the injected flow is formed so that a part of the injected flow runs downward for covering the surface of the side wall in which the air intake ventilation hole 141 is included. The air intake ventilation hole 141 is partially covered or brushed by the running flow, so the fluctuation rhythm of the air blow is generated, wherein the temporary air pressure decrease in the air cavity 120 given by the downward flowing of the injected flow and temporary air pressure recovery in the air cavity 120 given (Continued)

by the air blowing form the outer air are repeatedly. Therefore, the pulsatile flow or the intermittent flow is generated.

16 Claims, 16 Drawing Sheets

(52) U.S. Cl.
CPC ..... *E03C 1/084* (2013.01); *A61H 2033/022* (2013.01)

(58) Field of Classification Search
USPC ..... 239/428.5
See application file for complete search history.

(56) References Cited

U.S. PATENT DOCUMENTS 4,869,103 A * 9/1989 Jerman ..... A62C 31/02 73/198
5,826,799 A * 10/1998 Hsieh ..... B05B 7/0425 239/428.5
7,611,070 B2 * 11/2009 Paoluccio ..... B05B 7/0425 239/9
2012/0024984 A1 2/2012 Takano
2012/0234943 A1 9/2012 Ukigai et al.
2013/0214438 A1 8/2013 Takano

FOREIGN PATENT DOCUMENTS

JP 59-132957 A 7/1984
JP 63-229162 A 9/1988
JP 09-095985 A 4/1997
JP 10-296195 A 11/1998
JP 2000-104300 4/2000
JP 2001-123506 A 5/2001
JP 2012-047111 A 3/2012
WO 2010-109680 9/2010
WO 2012-033126 3/2012

* cited by examiner

Washing effect given by foamed water masses of the present invetion (a) The case that pulsatile flows or intermittent flows outflow at random (b) The case that foamed water mass flows synchronously

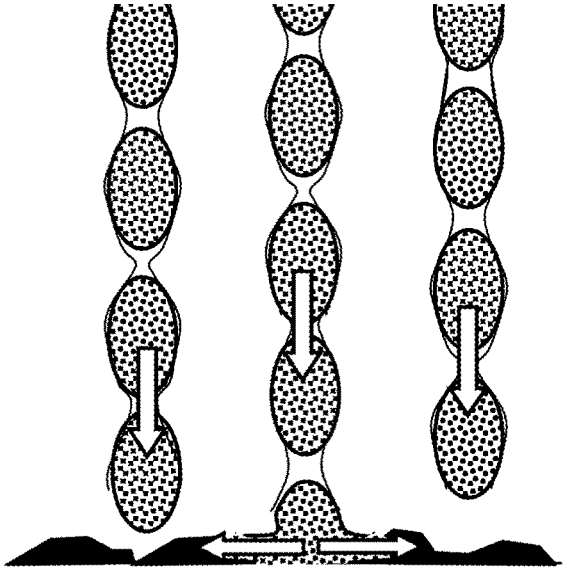

The center foamed water mass hits the dirt on the surface of the target. The motion energy is given to the dirt to wipe aside

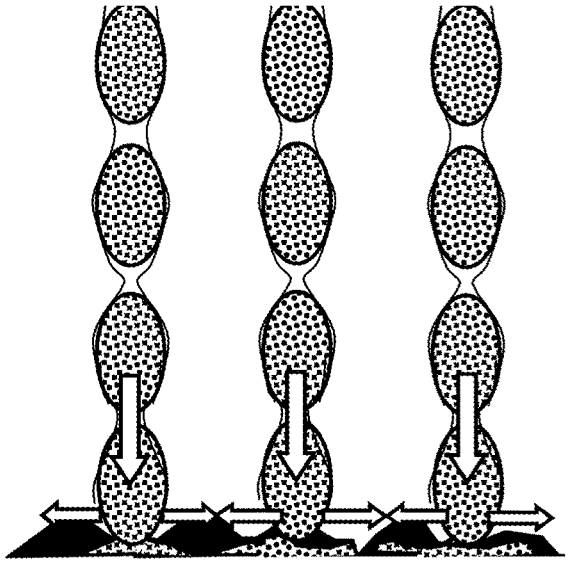

All foamed water masses crush at the same time, motion energy collides each other. A part of motion energy is cancelled each other

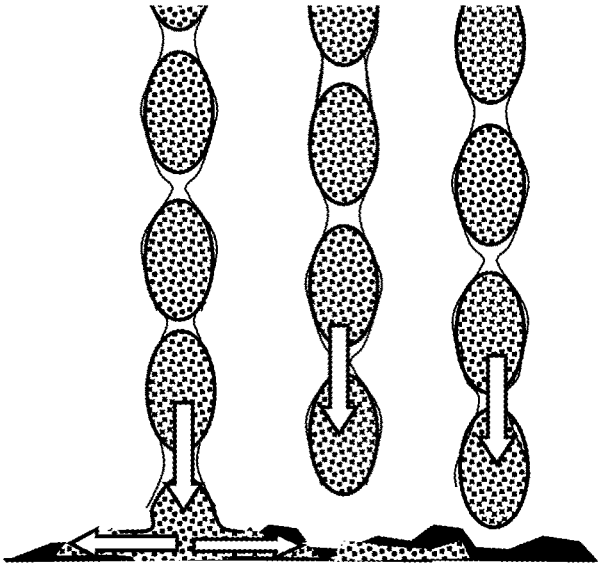

The next coming foamed water mass hits the dirt on the surface of the target. The motion energy is given to the dirt to wipe aside

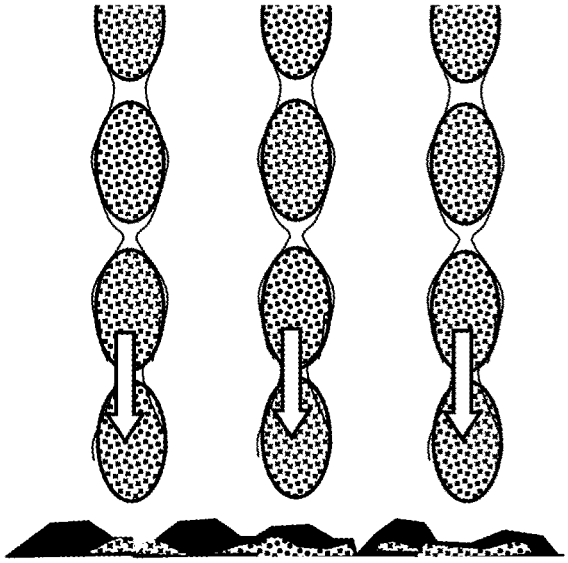

The washing effect is stopped at a moment until next coming foamed water masses comes to hit

Fig.14

Washing effect given by the conventional simple smooth water flow

DEVICE FOR GENERATING PULSATILE FLOW OR INTERMITTENT FLOW

TECHNICAL FIELD

This invention relates to a device for generating a pulsatile flow or intermittent flow from a continuous liquid flow or continuous gas flow. As the flow, not only water but also various liquids or gasses can be employed.

BACKGROUND ART

The handling of liquid flow or gas flow is applied to various apparatus. For example, water flow and gas flow are used in home and office via a water pipe and a gas pipe. Various liquid flow and gas flow are applied to various apparatus, and such apparatus is used in various places such as a manufacturing facility or a research laboratory.

Hereinafter, the water flow handling technology in the prior art is shown as an example.

In the prior art, tap water is widely used in various places such as the home and the commercial facility. The tap water flow running from the water faucet is formed as the continuous smooth flow without break and large fluctuation even though the tap water flow is not physically perfect smooth water flow and in fact contains micro fluctuation.

One important application among the water applications is washing. Especially, foamed water is suitable for washing hands and dishes. Foamed water is preferably employed for washing because foamed water has nice soft touch when washing hands with foamed water, and foamed water has soft gentle flow when washing glasses and dishes without damage on the glasses and dishes. There is another merit of foamed water for washing in that there are small amounts of splashing and rebounding when foamed water hits the glasses and dishes, so foamed water is employed widely in various water taps such as home, train station, public facilities and research laboratory.

Patent prior art 1: JP H09-095985

Patent prior art 2: JP 2000-104300

DISCLOSURE OF THE INVENTION

The Problems to be Solved

The water flow is examined in view of the washing application.

Generally, the water tap flow is used for washing an object by applying the water tap flow onto the surface of the target object. To enhance the washing effect, a washing agent and a washing rubbing tool such as a sponge are used for rubbing the surface of the target object, but basically the dirt on the surface of the target object is washed away by the water flow running onto the target object.

The motion of the conventional water tap flow is described in detail.

FIG. 16 is a schematic view of conventional washing action by applying the conventional continuous water flow to the target object. The water flow running from the water faucet onto the surface of the target object is an unbroken continuous smooth flow. The water hitting the surface of the target object spreads outward along the surface of the target object. Simultaneously, the water hitting the surface of the target object reflects and rebounds on the surface of the target object. Therefore, as shown in FIG. 16 (*b*) and FIG. 16 (*c*), the falling water and the rebounding water collide and reduce the flow strength above the surface of the target object. As a result, a kind of water dome is formed on the surface of the target. In addition, surface tension works there. Therefore, as shown in FIG. 16 (*d*), the flow strength of the unbroken continuous smooth water flow flowing from the faucet is reduced by the rebounded water from the surface of the target object, and the falling water being blocked by the water dome formed on the surface of the target object. As a result, water flows to the outside along the surface of the water dome. The ratio of the water directly hitting the dirt on the surface of the target object reduces and the ratio of the water flowing to the outer direction increases.

The ratio of the water effectively used for washing the dirt is small, as most water flows along the surface of water dome formed on the surface of the target as shown in FIG. 16 (*e*).

The problem to be solved is to form the water flow suitable for the washing by increasing the ratio of the water effectively used for washing the dirt and reducing the ratio of the water flow along the surface of the water dome formed on the surface of the target.

Masaaki TAKANO, who is the inventor of this invention, studied and found that effective excellent washing can be performed by applying pulsatile flow or intermittent flow to the washing target object, which is generated from unbroken continuous smooth water.

Masaaki TAKANO also noticed that there is no effective technology for transforming the unbroken continuous smooth water into the pulsatile flow or the intermittent flow without a particular electric device.

The fine water flow such as shower flow turns its shape from the unbroken continuous smooth water flow to the intermittent flow by travelling the long distance in the air. However, this phenomenon requires long travel distance in the air based on the diameter of the flow.

Other means for generating the pulsatile flow or the intermittent flow immediately after flashing the water faucet are a technology employing the electrical actuator for repeating the switch on and off the injector and a technology employing the piezo device for repeating the switch on and off the micro injector applied to the toilet seat with a washing function. However, the system become complex and the electrical operation is required. Therefore, a device for generating the pulsatile flow or the intermittent flow with less electrical elements is required.

The technology for generating the pulsatile flow or the intermittent flow from the unbroken continuous smooth water flow is required not only in the washing technology field but also in various technical fields. There are too many examples to count, but several of them are described below.

For example, the pulsatile flow or the intermittent flow is required in the manufacturing technology field. For example, in the semiconductor manufacturing field, the pulsatile flow or the intermittent flow is required in the process for introducing the material to be processed to the reactor chamber via the carrier flow. Herein, the example of the carrier flow is an inert gas. As another example, in the water jet peening for peening the surface of the structural membrane field, the pulsatile flow or the intermittent flow is required. The apparatus for generating the peening water jet is required to be a simple structure with less electrical operation elements.

For example, the pulsatile flow or the intermittent flow is required in the cleaning technology field and the purification technology field. The pulsatile media flow or the intermittent media flow is used in the cleaning process and the removing process instead of the conventional scraper. The pulsatile media flow or the intermittent media flow is used in the cleaning process and the removing process instead of the conventional scraper. The pulsatile media flow or the intermittent media flow is used for removing the cut residue or the cullet by blowing away with the pulsatile media flow or the intermittent media flow. The apparatus for generating the pulsatile media flow or the intermittent media flow is required to be a simple structure with less electrical operation elements.

For example, the pulsatile flow or the intermittent flow is required in the measurement technology, for example, the apparatus for analyzing the influence of the pulsatile media flow or the intermittent media flow in the measurement system. As another example, the apparatus can be for measuring the influence of the pulsatile media flow or the intermittent media flow for simulation. The apparatus for generating the pulsatile media flow or the intermittent media flow is required to be a simple structure with less electrical operation elements.

For example, the pulsatile gas flow or the intermittent gas flow is required in the gas turbine burner, the heat accumulating radiant tube burner and the jet engine. These apparatuses require the stability technology for such pulsatile gas flow or the intermittent gas flow via the compressor. The apparatus for generating the pulsatile gas flow or the intermittent gas flow is required to be a simple structure with less electrical operation elements.

For example, the pulsatile flow or the intermittent flow is required in the medical apparatuses and the medical devices, for example a liquid injector for cutting the tissues or removing the cut tissues requires such pulsatile liquid flow or the intermittent liquid flow. Such medical apparatus for generating the pulsatile media flow or the intermittent media flow is required to be a simple structure with less electrical operation elements.

The living organisms contain blood, body fluid and other aqueous fluid, so the measurement or the surgical operation is conducted by using those media in the pulsatile media flow or the intermittent media flow. For example, the micro fluid device for the automatic reaction apparatus for tissue chemical uses the pulsatile media flow or the intermittent media flow. Such medical apparatus for generating the pulsatile media flow or the intermittent media flow is required to be a simple structure with less electrical operation elements.

As shown above, the technology for generating the pulsatile flow or the intermittent flow is applied to various technical fields. The inventor Masaaki TAKANO develops the present invention to be applied to various technology fields. It is an object of the present invention to provide an apparatus for generating the pulsatile flow or the intermittent flow that can be applied to various technical fields.

Means for Solving the Problems

In order to achieve the above-mentioned object, the present invention of the device for generating pulsatile flow or intermittent flow to be attached to a liquid or gas providing apparatus, comprises; an injection mechanism for injecting liquid flow or gas flow; an air cavity provided below the injection mechanism, which includes an airtight space, an air intake ventilation hole provided at the side wall of the air cavity connecting to the outer air, and a draining portion for flowing the liquid flow or gas flow from the airtight space; wherein the injected flow is provided for fluctuating the ventilation amount of the outer air through the air intake ventilation hole by partially covering or brushing the air intake ventilation hole with a part of the injected flow by adjusting the hit portion of the injected flow or adjusting the reflection of the injected flow after hitting the side wall of the air cavity; pulsatile flow or intermittent flow is generated from the liquid flow or gas flow from the injection mechanism to fluctuate by the blown air flow wherein the strength rhythm of the intake outer air blow is given by fluctuation of the balance between the temporarily decreasing air pressure generated in the air cavity by flowing the liquid or gas flow from the draining portion and the temporarily recovering air pressure in the air cavity by the outer air flowing via the air intake ventilation hole.

According to the above configuration, the device for generating pulsatile flow or intermittent flow of the present invention can generate pulsatile flow or intermittent flow by utilizing the strength rhythm of the intake outer air blow given by fluctuation of the balance between the temporarily decreasing air pressure generated in the air cavity by flowing the liquid or gas flow from the draining portion and the temporarily recovering air pressure in the air cavity.

It is preferable that the diameter and the shape of the draining portion are adjusted so that the draining portion is totally covered with and filled with the injected flow for blocking the air backflow from the outer air. When there is no air backflow from the outer air via the draining portion, the fluctuation of the air pressure decreasing and the air pressure recovering in the air cavity becomes clear and sharp.

There are several patterns of the relationship between the injected flow and the blown outer air via the air intake ventilation hole.

The first pattern is that the injected flow hits the air cavity wall and flows along the air cavity wall and covers the all of the air intake ventilation hole to seal it, when the decrease in air pressure proceeds, finally the air blown pressure of the air intake ventilation hole can break the water flow in front of the air intake ventilation hole. Then the air pressure increases and the air blown pressure of the air intake ventilation hole becomes small and the water flow re-seals the air intake ventilation hole. The first pattern repeats this break and seal of the air intake ventilation hole as an ON-OFF pattern.

The second pattern is that the injected flow hits the air cavity wall and flows along the air cavity wall and covers a part of the air intake ventilation hole, so a small amount of air ventilation is secured but the air ventilation amount is limited and controlled. There is fluctuation of the air intake ventilation amount repeatedly. When the air intake ventilation amount becomes large, the outer air is blown by breaking the water flow in front of the air intake ventilation hole. When the air intake ventilation amount becomes small, the blown outer air is small and the water flow covers a part of the air intake ventilation hole.

The third pattern is that the injected flow hits the blown air directly in front of the air intake ventilation hole and the air ventilation amount is limited and controlled. There is fluctuation of the air intake ventilation amount repeatedly from the collision. When the air intake ventilation amount becomes large, the blown outer air becomes large to overcome the injected flow. When the air intake ventilation amount becomes small, the blown outer air becomes small to seal the air intake ventilation hole with the injected flow.

As those several patterns between the injected flow and the blown outer air via the air intake ventilation hole generate the pulsatile flow or intermittent flow by the strength rhythm of the intake outer air blow.

The shape of the pulsatile flow or intermittent flow generated by the device for generating pulsatile flow or intermittent flow of the present invention becomes an almost ball-shape drop or a continuous plurality of almost ball-shape drops flowing as a pulsatile flow or intermittent flow. Regarding the connection state between the liquid drops, each drop can be connected each other. If there is a gap between the liquid drops, a very small gap can be employed as if these appear to be forming a fluctuated flow. For example, at least several tens to several hundreds of pulses per second can be employed.

Regarding the strength of the blown air pressure, it should be enough for breaking the injected flow flowing in front of the air intake ventilation hole during the strong term of the strength rhythm of the intake outer air blow. The pulsatile flow or intermittent flow can be generated.

It is preferable that the main body structure in which the injected flow and the blown outer air are running through is surrounded by an outer element. When the air ventilation pass from the outer air to the air intake ventilation hole is formed between the main body and the outer element, the speed of the blown outer air becomes faster and the amount of the blown air becomes large.

The air cavity is provided as a passage route for the injected flow and, as an airtightness space, is provided as the space where the input flows are only the injected flow from the injection mechanism and the air flow from the air intake ventilation hole, and the output flow is only the pulsatile flow or the intermittent flow from the draining portion. There is no other input flow and output flow. The inner air of the air cavity is maintained even after the injected flow flows. Such air cavity can obtain sharp fluctuation of repeating the air pressure decreasing by the injected flow flowing down through the air cavity and the air pressure increasing by the blown outer air flowing into the air cavity; it is easier to generate the rhythm of the blown outer air and the pulsatile flow or the intermittent flow can be generated efficiently.

The present invention of the device for generating pulsatile flow or intermittent flow can employ plural sets of the above mentioned devices for generating pulsatile flow or intermittent flow. These devices are arrayed at predetermined intervals, and the rhythm of the pulsatile flow or the intermittent flow from each draining portion of the device become random, not synchronized with each other.

According to the above configuration, there are plural flows of the pulsatile flows and the intermittent flows. The strength rhythm of each flow becomes random, and if each flow hits the target object, water for washing the target object fluctuates in various directions.

Effect of the Invention

According to the above-mentioned configuration of the invention of the device can generate pulsatile flow or intermittent flow.

For example, a water tap employing the device of the present invention can provide a pulsatile flow or intermittent flow for washing water having high quality of washing effect. The device of the present invention can be combined with various water apparatus.

For example, the device of the present invention can be combined with a manufacturing apparatus such as an apparatus for a semiconductor. The pulsatile flow or the intermittent flow can be employed as carrier gas flow for introducing the reaction material to the reaction chamber. Herein, an inert gas is employed as the carrier flow. For example, the pulsatile flow or the intermittent flow can be employed as water jet peening flow for applying to the target surface of the metal structure. The device of the present invention can be combined with various manufacturing apparatus.

For example, the device of the present invention can be applied to the cleaning apparatus and removing apparatus. For example, the pulsatile flow or the intermittent flow can be employed to the cleaning apparatus or the removing apparatus instead of the conventional scraper. For example, device of the present invention can be combined with the cleaning apparatus or the removing apparatus for cleaning or removing the cut residue and cullet. The device of the present invention can be combined with various manufacturing apparatus.

For example, the device of the present invention can be applied to the measurement apparatus. For example, there are an apparatus for analyzing the flow effect of the gas flow or the liquid low and an apparatus for forming the pulsatile flow or the intermittent flow for simulation. The device of the present invention can be combined with various measurement apparatus.

For example, the device of the present invention can be applied to the apparatus for generating the pulsatile flow or the intermittent flow of gas for a gas turbine burner or a radiant tube burner or a jet engine. The device of the present invention can be combined with various gas burner apparatus.

For example, the device of the present invention can be applied to the apparatus for generating the pulsatile flow or the intermittent flow for a medical apparatus or a tissue chemical reactor apparatus. The device of the present invention can be combined with various medical apparatus.

BRIEF DESCRIPTION OF THE DRAWINGS

FIG. 14 is a schematic view showing the dirt washing effect by the device for generating the pulsatile flow or the intermittent flow 100-2.

DETAILED DESCRIPTION OF THE PREFERRED EMBODIMENT

Some embodiments of a device for generating pulsatile flow or intermittent flow according to the present invention are described below with reference to the relevant drawing. Needless to add, the claims of the present invention include but are not limited to the application, configuration, or quantity shown in the following embodiments.

Embodiment 1

Figure 1:
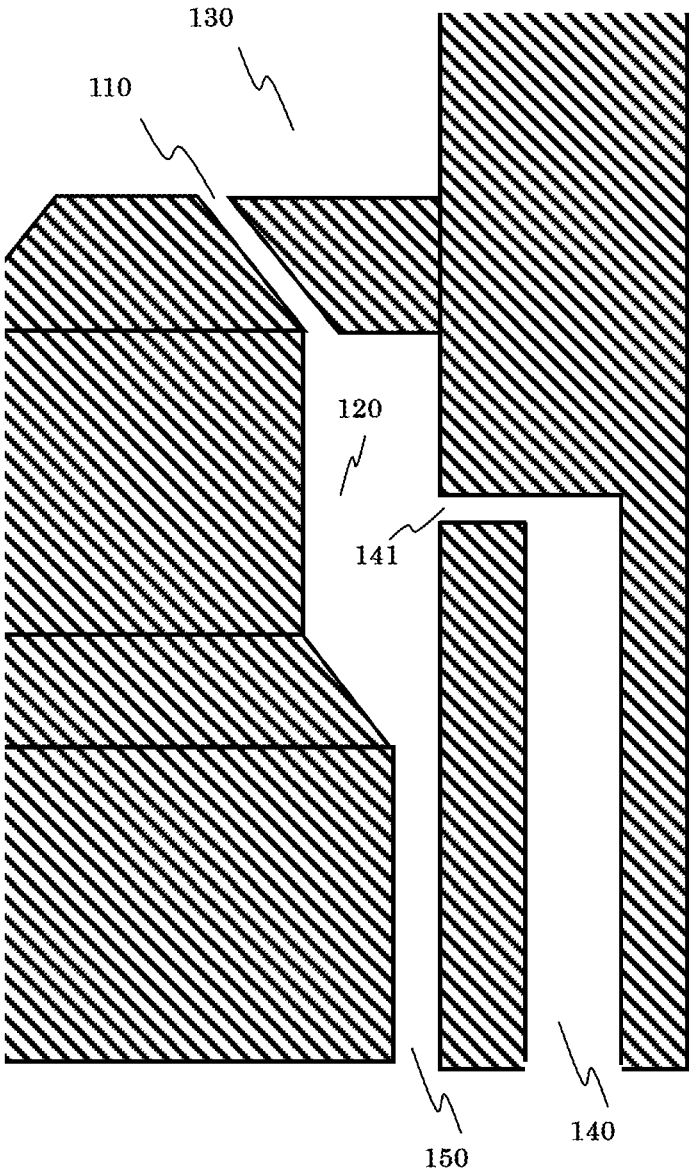
FIG. 1 is a schematic view of the device for generating the pulsatile flow or the intermittent flow 100 of the present invention in embodiment 1.

FIG. 1 shows a schematic view of the device for generating pulsatile flow or intermittent flow 100 as an example of this embodiment 1. FIG. 1 shows only a part of the device for generating pulsatile flow or intermittent flow 100. An injection mechanism 110, an air cavity 120, an input portion 130, an air intake ventilation pass 140, an air intake ventilation hole 141 and a draining portion 150 are shown in FIG. 1.

The input portion 130 is a tool for introducing the flow medium from the flow medium provider such as a water tap. The input portion 130 shows as a container space above the injection mechanism 110 shown in FIG. 1. The input portion 130 is a pass for connecting the flow medium provider and the injection mechanism 110. The flow medium provider and the attachment structure are omitted in FIG. 1.

The injection mechanism 110 is a mechanism for injecting the flow by narrowing the passing area for water flow. In this configuration, the injection mechanism 110 is installed below the input portion 130. The injection mechanism 110 accepts the water from the input portion 130 and narrows the passing area to inject water as a rapid injected flow.

The injection angle of the injection mechanism 110 is adjusted as the angle for injecting the water flow around the air intake ventilation hole 141 and after hitting, the water flows by partially covering or brushing the air intake ventilation hole with a part of the injected flow.

An air cavity 120 comprises the injection mechanism 110 installed in the upper portion and the draining portion installed in the lower portion providing an airtight space filled with the air blown via the air intake ventilation hole 141. The air cavity 120 accepts only the injected flow by the injection mechanism 110 and the blown outer air via the air intake ventilation hole 141 and outputs only the pulsatile flow or the intermittent flow from the draining portion 150. The air cavity maintains airtightness by being enclosed except for the above input and output.

Figure 2:
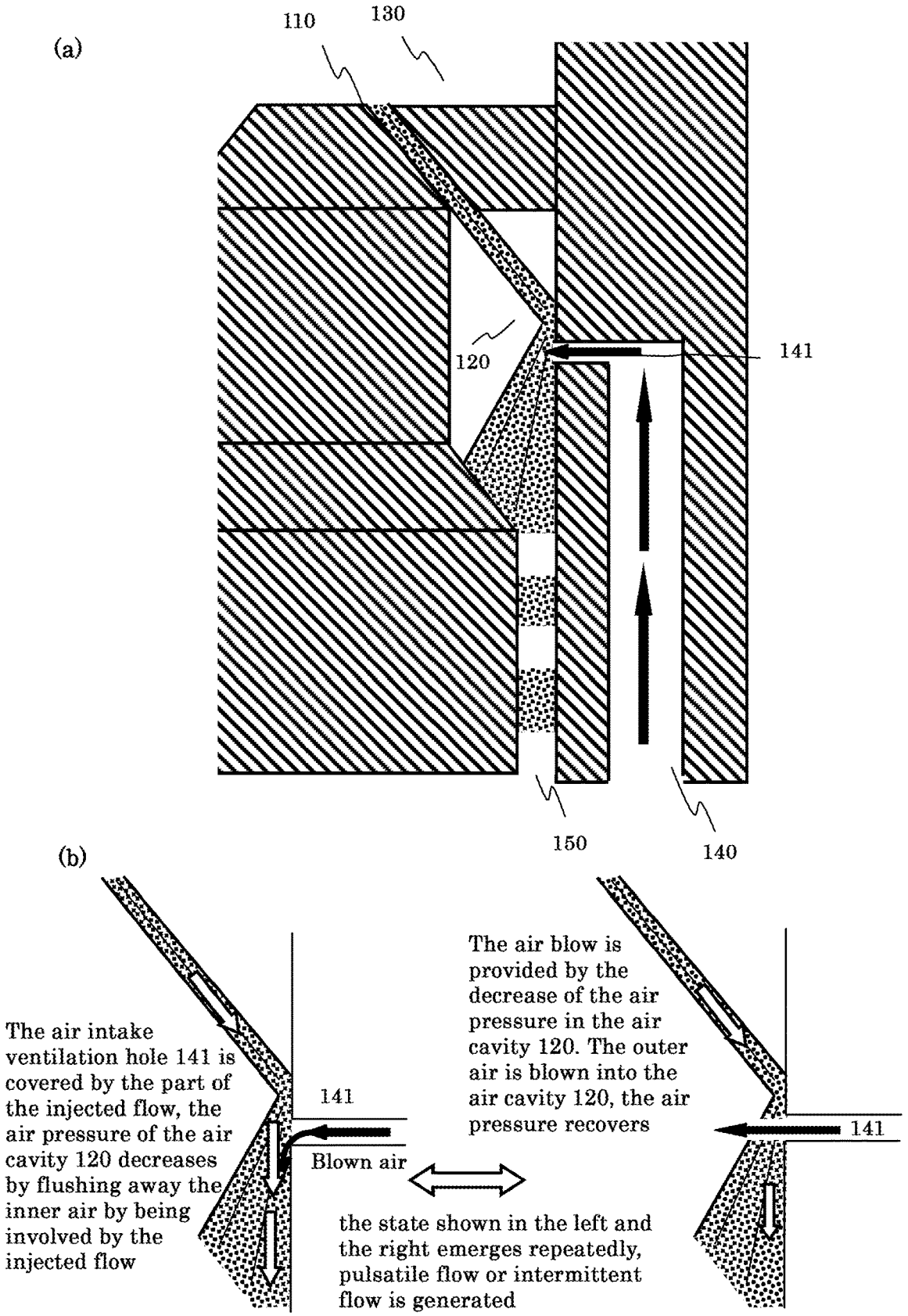
FIG. 2 is a schematic view showing the state of the device for generating the pulsatile flow or the intermittent flow 100 shown in FIG. 1 in which water flow flows.

FIG. 2 is a schematic view showing the state of the device for generating the pulsatile flow or the intermittent flow 100 shown in FIG. 1 in which water flow flows.

As shown in FIG. 2, the basic working of the device for generating the pulsatile flow or the intermittent flow 100 is that the injected flow injects from the injection mechanism 110 into the air cavity 120, the injected flow involves the inner air of the air cavity 120 and outflows from the draining portion 150.

The air pressure of the air cavity 120 decreases because the injected flow involves the inner air of the air cavity 120 and outflows from the draining portion 150. Therefore, outer air is blown from the air intake ventilation hole 141 through the air intake ventilation pass 140.

The angle of the nozzle of the injection mechanism 110 is adjusted for injecting the water flow around the air intake ventilation hole 141 and after hitting, the water flows by partially covering or brushing the air intake ventilation hole 141 with a part of the injected flow. In the configuration shown in FIG. 2, the angle of the nozzle of the injection mechanism 110 is adjusted for injecting the water flow just above the air intake ventilation hole 141. After hitting the side wall, the water flow expands and flows downwardly along to the side wall. The air intake ventilation hole 141 is covered by the part of the injected flow, and the opening of the air intake ventilation hole 141 is sealed by the water wall of the injected flow.

The fluctuation of the air pressure in the air cavity 120 is described as follows.

As shown in FIG. 2, the air pressure of the air cavity 120 decreases by flushing away the inner air by being involved by the injected flow. It is understood that as the air contained in the airtight small space is pushed out, the air pressure becomes small.

There is air blow from the air intake ventilation hole 141 to the air cavity 120 through the air intake ventilation pass 140. The air blow is provided by the decrease of the air pressure in the air cavity 120. As the outer air is blown into the air cavity 120, the air pressure recovers.

The air pressure decrease and recovery is not maintained in equilibrium. Because the flowing water wall covering the air intake ventilation hole 141 is broken and recovered repeatedly, the states shown in the left in FIG. 2 (*b*) and the right in FIG. 2 (*b*) emerge repeatedly.

The state shown in the left in FIG. 2 (*b*) shows the state in which the opening of the air intake ventilation hole 141 is covered with the water flow formed by the injection mechanism and sealed. In this state, the air ventilation via the air intake ventilation hole 141 is blocked, and the inner air of the air cavity 120 is flushed downwardly with the injected water flow. The air pressure of the air cavity 120 decreases.

The state shown in the right in FIG. 2 (*b*) shows the state in which the opening of the air intake ventilation hole 141 is ventilated by breaking the water flow formed by the injection mechanism because the air intake pressure becomes large relative to the decrease of the air pressure of the air cavity 120. In this state, the air pressure of the air cavity 120 recovers because the air ventilation via the air intake ventilation hole 141 is secured by breaking the water flow in front of the opening of the air intake ventilation hole 141.

If the air pressure of the air cavity 120 becomes large, the air intake pressure becomes small, and finally the air blown flow cannot break the water flow flowing along the side wall and the air intake ventilation hole 141 is covered with the water flow flowing along to the side wall as shown in the left in FIG. 2 (*b*).

The air blown strength rhythm between the air pressure decreasing period without the air blown shown in left in FIG. 2 (*b*) and the air pressure increasing period with the air blown shown in right in FIG. 2 (*b*) is generated. As a result, the pulsatile flow or the intermittent flow is generated.

The relation between the air ventilation hole 141 and the injected flow shown in FIG. 1 and FIG. 2 is as follows. There is no ventilation upon shutting down the opening of the air ventilation hole 141 by the flowing water film formed by injected flow as shown in the left in FIG. 2 (*b*). The same effect can be obtained even if the flowing water film does not perfectly cover the opening of the air ventilation hole 141 but the flowing water film brushes the air intake ventilation hole to make a small gap for limited ventilation. This case is described in embodiment 2.

The injected flow passing through the air cavity 120 is mixed with the air in the air cavity 120 and it can turn to a foamed water flow because the injected flow is mixed with the air in the air cavity 120 and the air blown from outer air via the air ventilation hole 141 is smashed into the injected flow. When the air blowing from the air ventilation hole 141 gets bigger, the injected flow is broken or become thin by the blown air. As a result, the injected flow turns to be the pulsatile flow of foamed liquid mass or the intermittent flow of foamed liquid mass. Especially, when the original injected flow is injected in thin water film shape, it is easy to be broken and it can turn to be pulsatile flow of liquid mass or intermittent flow of liquid mass.

The generated liquid mass assimilates the air in the air cavity 120 and flushes to the draining portion 150. The air pressure of the air cavity 120 fluctuates repeatedly. When the air pressure of the air cavity 120 becomes large, pulsatile flow or intermittent flow can push and flush the air around the draining portion, and the involved air flows as air mass through the draining portion 150.

Figure 3:
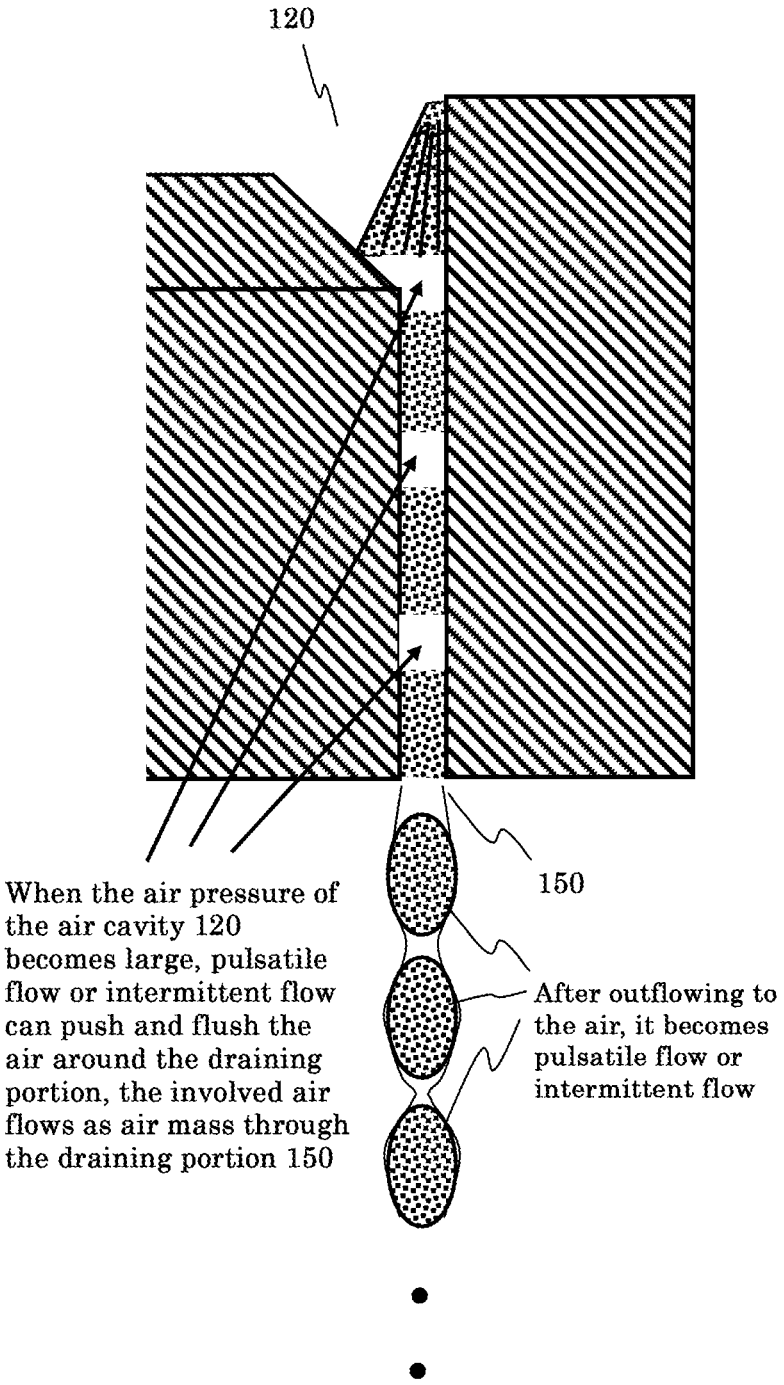
FIG. 3 is a schematic view showing the formed water mass flowing through the output part 150 containing air mass.

FIG. 3 is a schematic view showing the foamed water mass flowing through the output part 150 containing air mass. As shown in FIG. 3, the air mass is pushed by the liquid mass in the draining portion 150. If the air mass exists between the former liquid mass and the latter liquid mass, the former liquid mass and the latter liquid mass become independent from each other, and pulsatile flow or intermittent flow flows out through the draining portion 150.

In FIG. 3, the foamed liquid masses flowing through the draining portion 150 are described simply as an independent liquid mass. The foamed liquid masses may flow as an independent liquid mass and may flow as a merged liquid mass connected each other without clear boundary. However, the liquid mass flow becomes pulsatile flow or intermittent flow, not smooth continuous flow.

Figure 4:
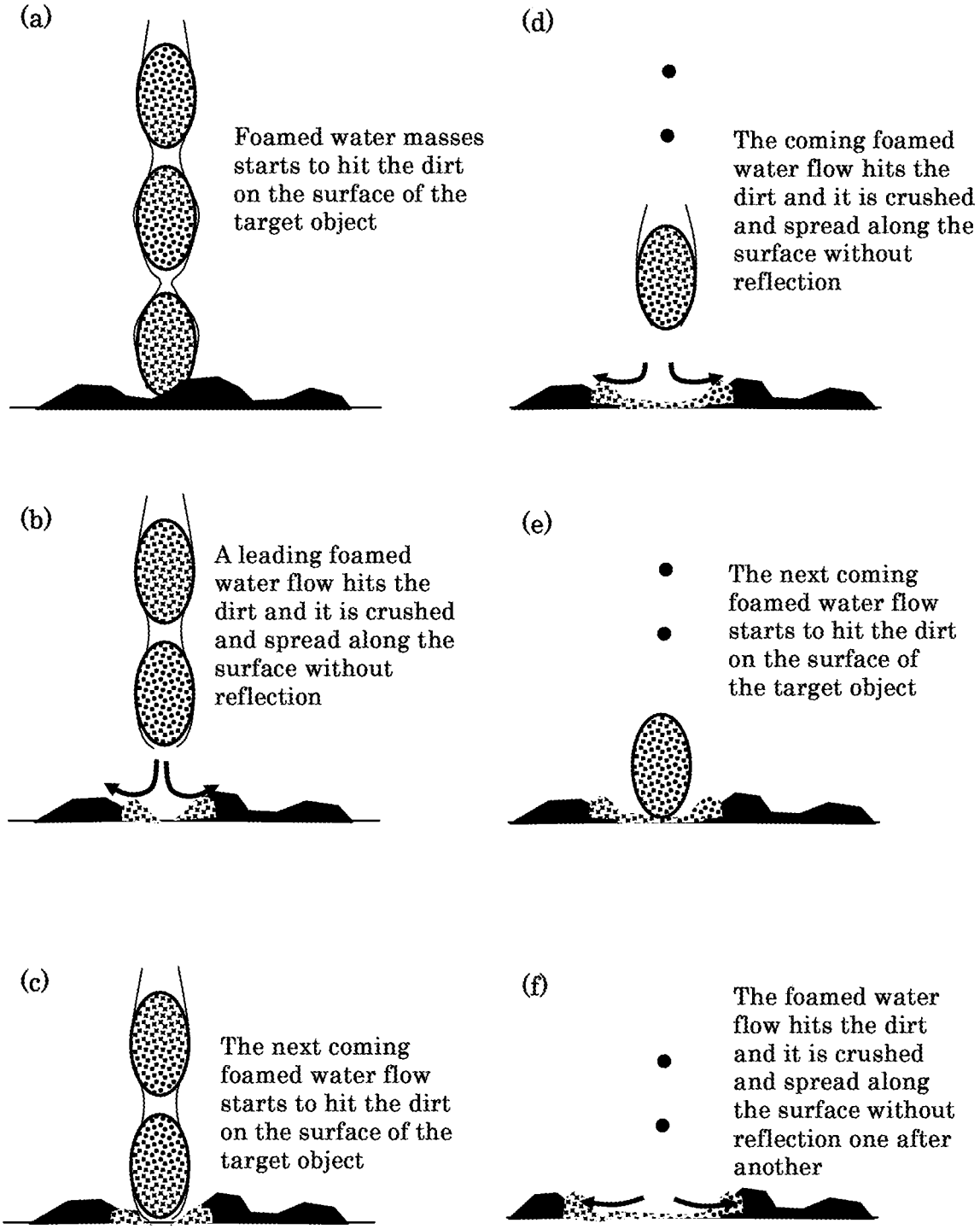
FIG. 4 is a schematic view showing foamed water flow generated by the device for generating the pulsatile flow or the intermittent flow 100 has a high quality of washing ability.

FIG. 4 is a schematic view showing foamed water flow generated by the device for generating the pulsatile flow or the intermittent flow 100 has a high quality of washing ability. FIG. 4 shows a momentary state describing the washing effect by pulsatile flow of foamed liquid mass or intermittent flow of foamed liquid mass. The foamed liquid masses hit the target object one after another.

FIG. 4 (*a*) is a schematic view showing foamed water masses starting to hit the dirt on the surface of the target object. FIG. 4 (*a*) shows the momentary state when a leading independent liquid mass of the pulsatile flow or the intermittent flow has begun to hit.

FIG. 4 (*b*) is a schematic view showing the state that the leading foamed water flow hits and smashes the dirt on the surface of the target object and the motion energy of the foamed water flow is applied to the dirt. After hitting the dirt on the surface of the target object, the independent liquid mass is crushed and spreads along the surface without reflection.

FIG. 4 (*c*) is a schematic view showing the state in which the next coming foamed water flow starts to hit the dirt on the surface of the target object.

FIG. 4 (*d*) is a schematic view showing the state in which the next coming foamed water flow hits and smashes the dirt on the surface of the target object and the motion energy of the foamed water flow is applied to the dirt. The leading foamed liquid mass is on the dirt. However, the crushed water spread flat, not in a swelling state because it is foamed water. The surface of the dirt is in an exposed state. The next coming foamed liquid mass hits and smashes the dirt to spread along the surface of the target.

FIG. 4 (*e*) is a schematic view showing the state in which the next coming foamed water flow starts to hit the dirt on the surface of the target object, FIG. 4 (*f*) is a schematic view showing the state in which the next coming foamed water flow hits and smashes the dirt on the surface of the target object and the motion energy of the foamed water flow is applied to the dirt. The dirt is pushed aside more compared to FIG. 4 (*d*). The dirt is swiped away efficiently by the hitting and smashing of the independent liquid masses one after another.

The liquid mass is a foamed liquid mass, and a swelling shape water mass is not formed on the dirt, so the surface of the dirt is easy to be exposed. The dirt is hit and smashed directly by the coming liquid masses one after another, and the motion energy is applied to the dirt consecutively. As shown above, the foamed liquid mass of the pulsatile flow or the intermittent flow has a high washing effect.

Figure 5:
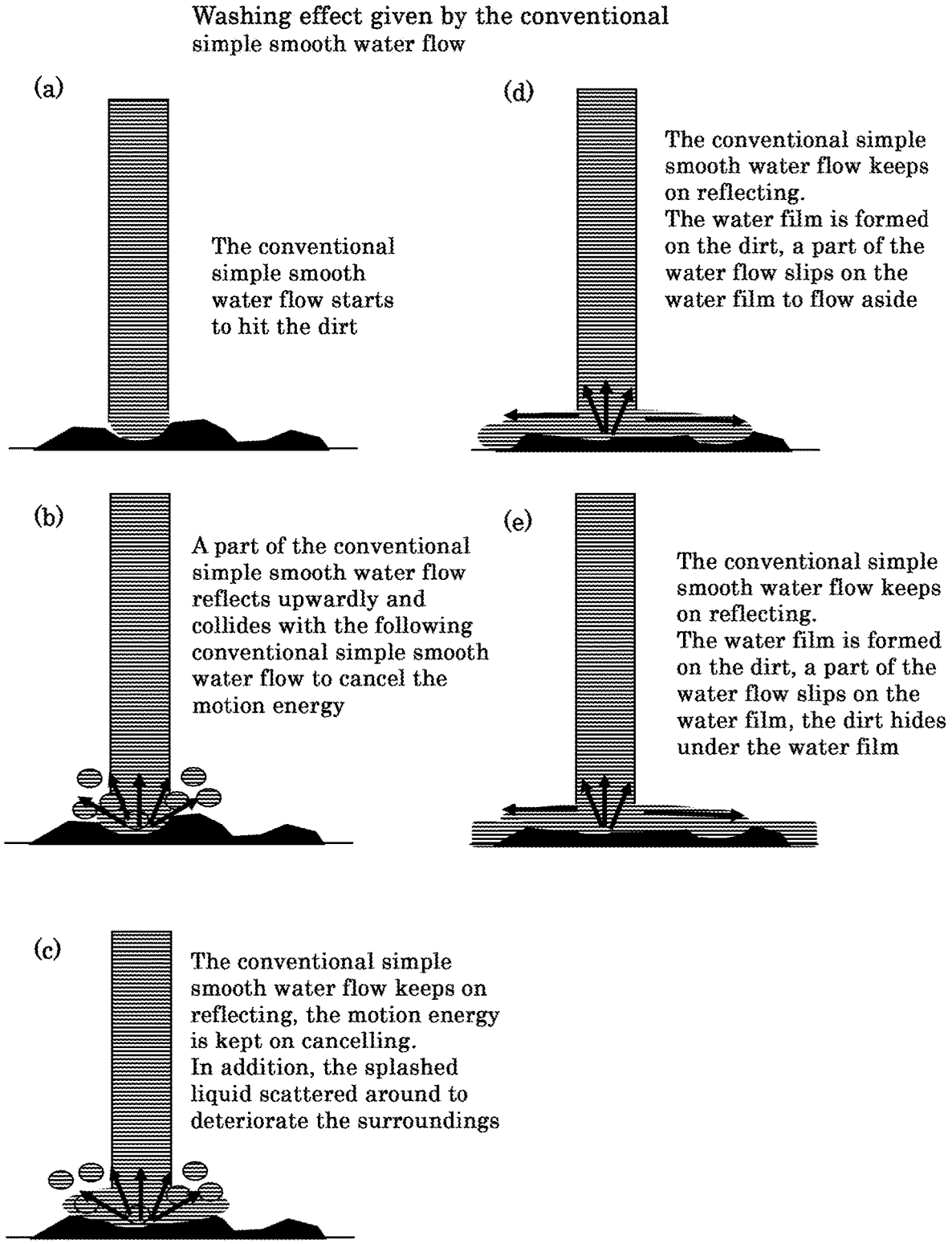
FIG. 5 is a schematic view showing the conventional washing manner with the conventional simple smooth water flow.

FIG. 5 is a schematic view showing the conventional washing manner with the conventional simple smooth water flow.

FIG. 5 (*a*) is a schematic view showing the conventional simple smooth water flow starts to hit the dirt on the surface of the target object.

FIG. 5 (*b*) shows the momentary state in which a leading portion of the conventional simple smooth water flow has begun to hit. As shown in FIG. 5 (*b*), a part of the conventional simple smooth water flow reflects upwardly and collides with the following conventional simple smooth water flow to cancel the motion energy. In addition, the splashed liquid scattered around to deteriorate the surroundings.

FIG. 5 (*c*) is a schematic view of the state after FIG. 5 (*b*). The conventional simple smooth water flow keeps on reflecting, and the cancellation of the motion energy of the next coming conventional simple smooth water flow continues. In addition, the splashed liquid scattered around to deteriorate the surroundings.

FIG. 5 (*d*) is a schematic view of the state after FIG. 5 (*c*). The conventional simple smooth water flow keeps on reflecting, and the cancellation of the motion energy of the next coming conventional simple smooth water flow continues. The water film is formed on the dirt, and a part of the next coming conventional simple smooth water flow slips on the water film to flow aside.

FIG. 5 (*e*) is a schematic view of the state after FIG. 5 (*d*). The reflection of the conventional simple smooth water flow continues, and the cancellation of the motion energy of the next coming conventional simple smooth water flow continues. The water film is formed on the dirt, and a part of the next coming conventional simple smooth water flow slips on the water film, so the dirt hides under the water film.

After FIG. 5 (*e*), the state shown in FIG. 5 (*e*) is maintained.

It is understood that the foamed liquid mass of the pulsatile flow or the intermittent flow has a higher washing effect than that of the conventional simple smooth water flow.

As shown above, the pulsatile flow or the intermittent flow is generated from the provided simple smooth water flow by applying the first principle of the device for generating pulsatile flow or intermittent flow of the present invention.

Embodiment 2

The principle of the device for generating pulsatile flow or intermittent flow 100*a* of the embodiment 2 of the present invention is described below.

Figure 6:
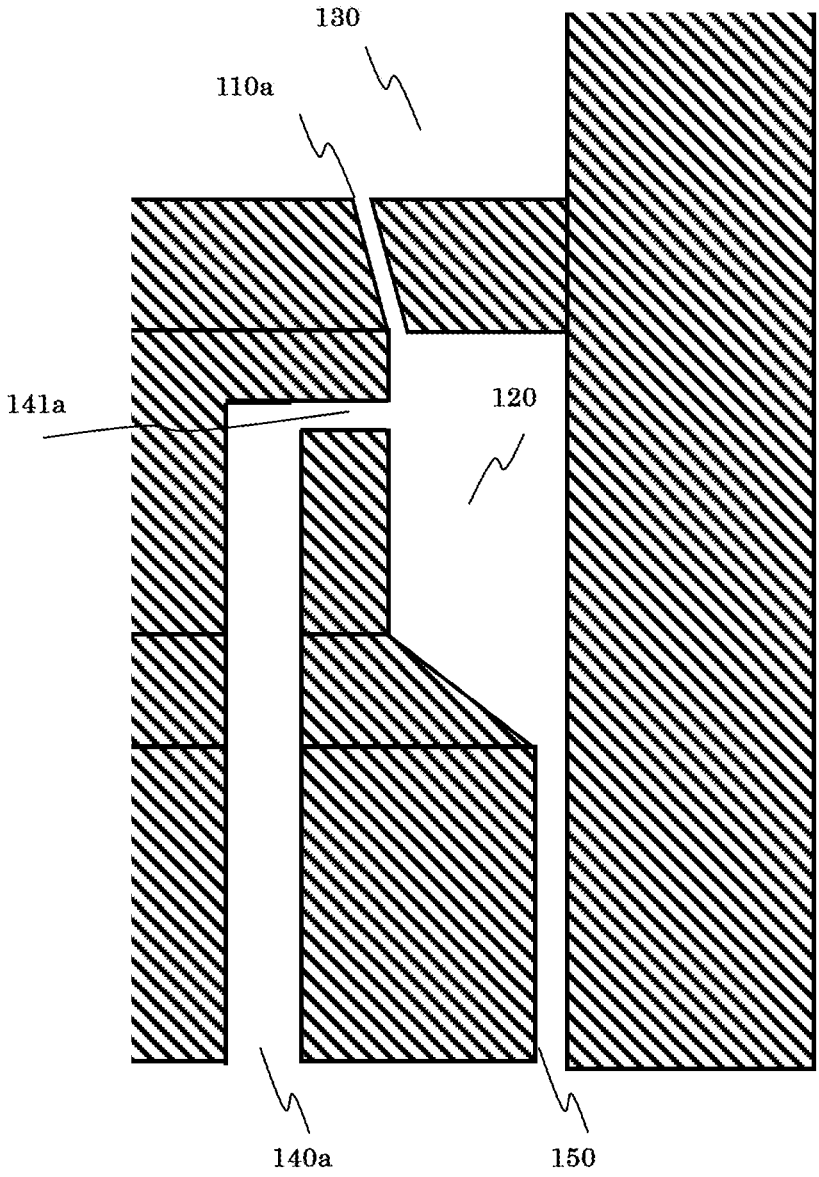
FIG. 6 is a schematic view of the device for generating the pulsatile flow or the intermittent flow 100*a* of the present invention in embodiment 2.

FIG. 6 is a schematic view of the device for generating the pulsatile flow or the intermittent flow 100*a* of the present invention in embodiment 2.

FIG. 6 shows only a part of the device for generating pulsatile flow or intermittent flow 100. An injection mechanism 110*a*, an air cavity 120, an input portion 130, an air intake ventilation pass 140*a*, an air intake ventilation hole 141*a* and a draining portion 150 are shown in FIG. 6.

The air cavity 120, the input portion 130 and the draining portion 150 shown in FIG. 6 are the same configurations shown in FIG. 1. The descriptions regarding those elements are omitted here.

The injection angle of the injection mechanism 110*a* is adjusted as the angle for injecting the water flow parallel to or with a slight skew relative to the wall in which the air intake ventilation hole 141*a* located.

The air intake ventilation hole 141 in FIG. 1 is located on the other side wall facing the flow direction of the injected flow of the injection mechanism 110. However, the air intake ventilation hole 141*a* in embodiment 2 is located on the same side wall along the flow direction of the injected flow of the injection mechanism 110*a*.

Figure 7:
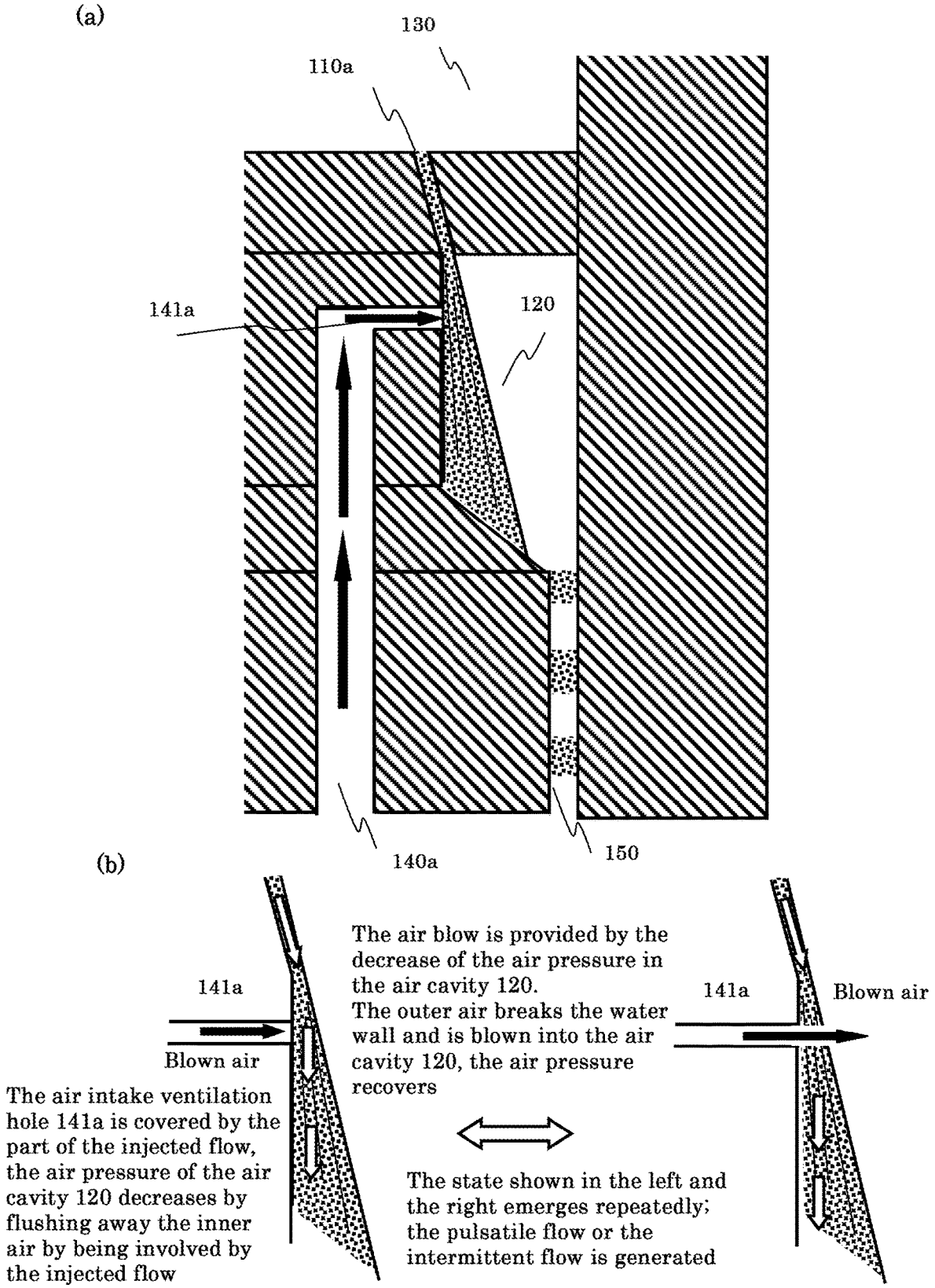
FIG. 7 is a schematic view showing the state of the device for generating the pulsatile flow or the intermittent flow 100*a* shown in FIG. 6 in which water flow flows.

FIG. 7 is a schematic view showing the state of the device for generating the pulsatile flow or the intermittent flow 100*a* shown in FIG. 6 in which water flow flows.

As shown in FIG. 7, the basic operation is the same as that of embodiment 1 in that the injected flow is injected by injection mechanism 110*a* to the inner air of the airtight space in the air cavity 120, and the injected flow assimilates the inner air and flows out via the draining portion 150.

The air pressure of the air cavity 120 decreases because the injected flow assimilates and brings out the inner air from the air cavity 120. Therefore, the outer air blows into the air cavity 120 via the air intake ventilation hole 141*a* through the air intake ventilation pass 140*a*.

The injected flow injected from the injection mechanism 110*a* flows parallel to or with a slight skew to the wall in which the air intake ventilation hole 141*a* located. It is possible that the flow direction of the injected flow turns to be parallel to the side wall of the air cavity 120 by the influence of the diffraction or the surface tension if there is a slight skew to the side wall. FIG. 7 shows the state in which a part of the injected flow curves along the side wall of the air cavity 120 by the influence of the diffraction or the surface tension.

As shown in FIG. 7, the opening of the air intake ventilation hole 141*a* is covered with the injected flow.

As shown in FIG. 7, the fluctuation of the air pressure in the air cavity 120 is described.

The air pressure of the air cavity 120 decreases because the injected flow assimilates the inner air of the air cavity 120 and outflows from the draining portion 150. It is understood that the air cavity 120 is a small airtight space, so the air pressure decreases by bringing the inner air to outside via the draining portion 150.

As shown in FIG. 7 (*a*), there is air intake from the outer air into the air cavity 120 via the air intake ventilation hole 141*a* through the air intake ventilation pass 140. This air intake is generated by the air pressure decreasing in the air cavity 120. When the outer air is blown into the air cavity 120, the air pressure of the air cavity recovers. There is a water film of the injected flow covering the air intake ventilation hole 141*a*, and the state shown in right in FIG. 7 (*b*) and the state shown in left in FIG. 7 (*b*) appear alternately.

The state shown in the left in FIG. 7 (*b*) is the state in which the opening of the air intake ventilation hole 141*a* is shut by the water film of the injected flow. In this state, the outer air blowing is shut momentarily, and the inner air is assimilated and brought from the air cavity 120, so the air pressure of the small airtight space of the air cavity 120 is decreasing.

The state shown in the right in FIG. 7 (*b*) is the state in which the opening of the air intake ventilation hole 141*a* is opened by breaking the water film of the injected flow by the outer air blowing when the air intake force gets bigger to break the water film of the injected flow. In this state, the outer air breaks the water film of the injected flow momentarily, and the inner air increases in air cavity 120, so the air pressure of the small airtight space of the air cavity 120 is increasing.

When the air pressure of the air cavity 120 recovers, the air intake force is decreasing, and finally the water film of the injected flow flows and covers the opening of the air intake ventilation hole 141*a* again.

As shown above, the fluctuation of the air blowing cycle of the air pressure between the air decreasing state without the outer air blowing shown in the left of FIG. 7 (*b*) and the air pressure increasing state with the outer air blowing shown in the right appear alternately. The pulsatile flow or the intermittent flow of the present invention is provided.

The relation between the air ventilation hole 141*a* and the injected flow shown in embodiment 2 is as follows. The same effect can be obtained even if the flowing water film does not perfectly cover the opening of the air ventilation hole 141*a* and there is some limited air ventilation by brushing the air intake ventilation hole 141*a* by the water film.

Figure 8:
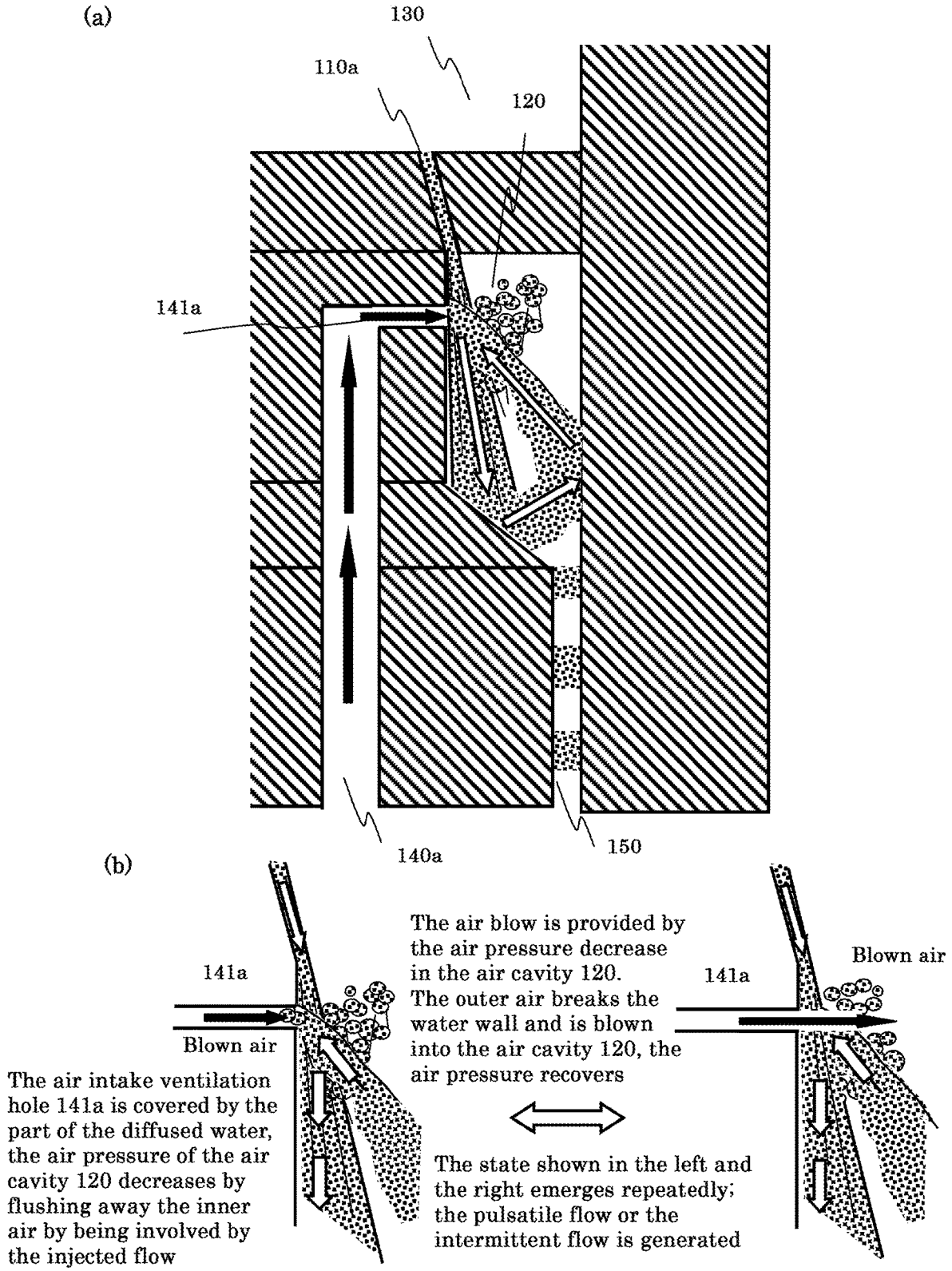
FIG. 8 is a schematic view showing the mechanism of limiting the amount of the outer air ventilation through the gap around the intake hole by partially covering or brushing the air intake ventilation hole.

As shown in FIG. 8, the water diffusion may occur by reflecting the injected flow and covering the opening of the air ventilation hole 141*a* after hitting the side wall of the air cavity 120 depending on the condition of the side wall figure and the hit angle. The case shown in FIG. 8 satisfies such condition for water diffusion.

The opening of the air ventilation hole 141*a* is covered by a part of the diffused injected flow in FIG. 8.

The diffusion of the injected flow is designed and controlled intentionally, not accidentally, by adjusting the angle of the injection mechanism 110*a* and the shape and figure of the air cavity 120 for covering the opening of the air ventilation hole 141*a* with the diffused water consecutively.

The state shown in the left in FIG. 8 (*b*) is the state in which the opening of the air intake ventilation hole 141*a* is disclosed by being covered with the diffused water of the injected flow. In this state, the outer air is blocked by the water film of the injected flow momentarily, and the inner air decreases in air cavity 120, so the air pressure of the small airtight space of the air cavity 120 is decreasing.

The same as FIG. 7 (*b*), the state in the left in FIG. 8 (*b*) and the right in FIG. 8 (*b*) are repeated.

As shown above, the pulsatile flow or the intermittent flow is generated from the provided simple smooth water flow by applying this second principle of the device for generating the pulsatile flow or intermittent flow of the present invention.

Embodiment 3

The principle of the device for generating pulsatile flow or intermittent flow 100*b* of the embodiment 3 of the present invention is described below.

Figure 9:
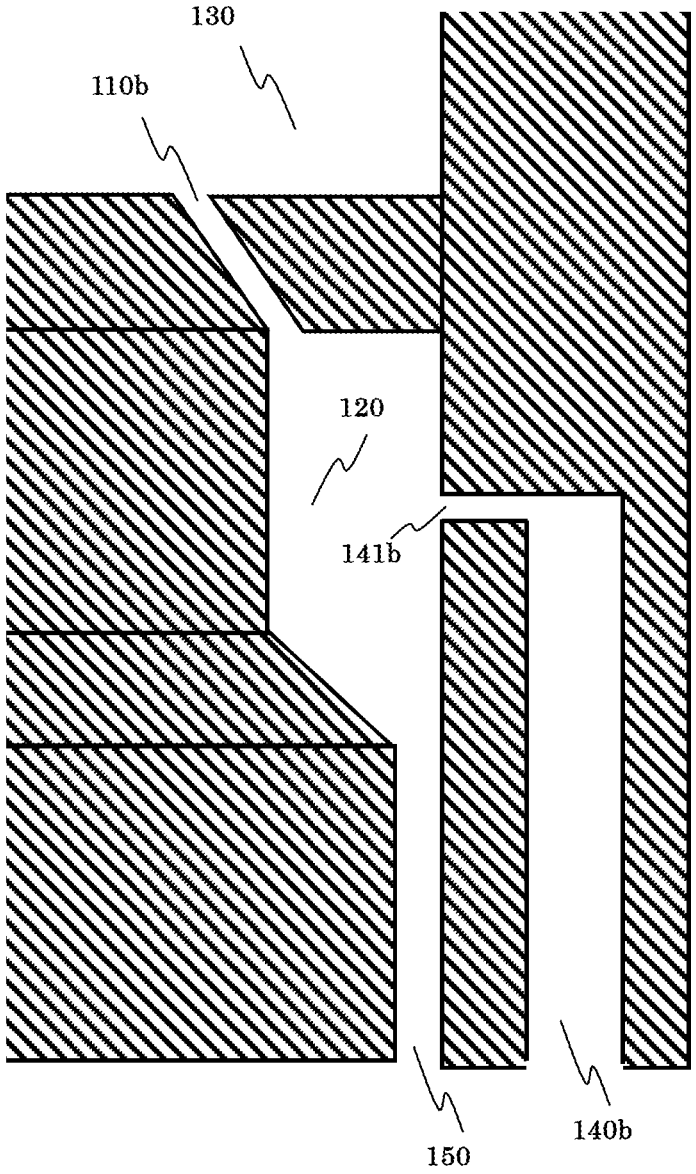
FIG. 9 is a schematic view of the device for generating the pulsatile flow or the intermittent flow 100*b* of the present invention in embodiment 3.

FIG. 9 is a schematic view of the device for generating the pulsatile flow or the intermittent flow 100*b* of the present invention in embodiment 3.

FIG. 9 shows only a part of the device for generating pulsatile flow or intermittent flow 100*b*. An injection mechanism 110*b*, an air cavity 120, an input portion 130, an air intake ventilation pass 140*b*, an air intake ventilation hole 141*b* and a draining portion 150 are shown in FIG. 9.

The air cavity 120, the input portion 130 and the draining portion 150 shown in FIG. 9 are the same configurations shown in FIG. 2. The descriptions regarding those elements are omitted here.

The injection angle of the injection mechanism 110*b* is adjusted as the angle for injecting the water flow nearby the opening of the air intake ventilation hole 141*b* and the blown outer air and the injected flow collide with each other.

Figure 10:
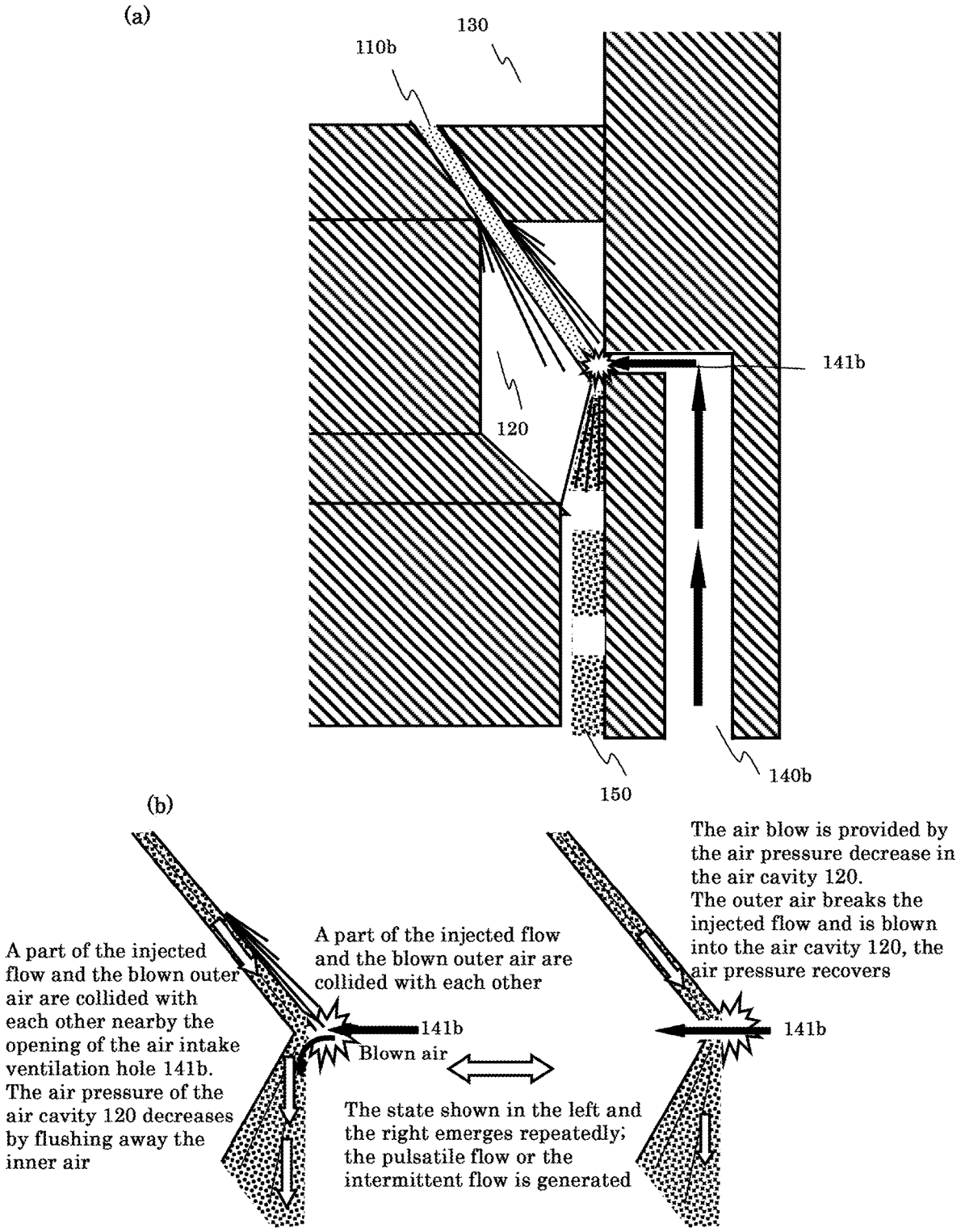
FIG. 10 is a schematic view showing the state of the device for generating the pulsatile flow or the intermittent flow 100*b* in which water flow flows.

FIG. 10 is a schematic view showing the state of the device for generating the pulsatile flow or the intermittent flow 100*b* shown in FIG. 9 in which water flow flows.

As shown in FIG. 10, the basic operation is the same as that of embodiment 1 in that the injected flow is injected by injection mechanism 110*b* to the inner air of the airtight space in the air cavity 120, and the injected flow assimilates the inner air and flows out via the draining portion 150.

The air pressure of the air cavity 120 decreases because the injected flow assimilates and brings out the inner air from the air cavity 120. Therefore, the outer air blows into the air cavity 120 via the air intake ventilation hole 141*b* through the air intake ventilation pass 140*b*.

The angle of the injection mechanism 110*b* is adjusted so the direction of the injected flow or the diffused flow is nearby the air intake ventilation hole 141*b*. Therefore, a part of the injected flow or a part of the diffused water and the blown outer air collide with each other nearby the opening of the air intake ventilation hole 141*b*. FIG. 10 shows the state in which diffused water and the blown outer air collide with each other nearby the opening of the air intake ventilation hole 141*b* according to the condition of the nozzle of the injection mechanism 110*b*.

The collision of the diffused water and the blown air is designed and controlled intentionally, not by accidentally, by adjusting the angle of the injection mechanism 110*b* and the shape and figure of the air cavity 120.

The fluctuation of the air pressure in the air cavity 120 is described.

As shown in FIG. 10, the air pressure of the air cavity 120 decreases because the injected flow assimilates the inner air of the air cavity 120 and outflows from the draining portion 150. It is understood that the air cavity 120 is a small airtight space, so the air pressure decreases by bringing the inner air to outside via the draining portion 150.

As shown in FIG. 10, there is air intake from the outer air into the air cavity 120 via the air intake ventilation hole 141*b* through the air intake ventilation pass 140*b*. This air intake is generated by the air pressure decreasing in the air cavity 120. When the outer air is blown into the air cavity 120, the air pressure of the air cavity recovers.

There is collision of the injected flow and the blown outer air. The collision does not form the smooth balance between the air decreasing and the air increasing in the air cavity. The collision generates fluctuation because the amount of the direction of the diffused water is not constant, and there are various momentary differences. The energy of the collision is not small, so the influence of the fluctuation seen in the injected flow and the fluctuation seen in the blown outer air causes the pulsatile flow or the intermittent flow dynamically. The state shown in the right in FIG. 10 (*b*) and the state shown in the left in FIG. 10 (*b*) appear alternately.

The state shown in the left in FIG. 10 (*b*) is the state in which the opening of the air intake ventilation hole 141*b* is shut by the diffused water of the injected flow. In this state, the outer air blowing is blocked momentarily, and the inner air is assimilated and brought from the air cavity 120, so the air pressure of the small airtight space of the air cavity 120 is decreasing.

The state shown in the right in FIG. 10 (*b*) is the state in which the opening of the air intake ventilation hole 141*b* is opened by breaking the diffused water wall of the injected flow by the outer air blowing when the air intake force gets bigger to break the diffused water wall of the injected flow. In this state, the outer air breaks the diffused water wall of the injected flow momentarily, and the inner air increases in air cavity 120, so the air pressure of the small airtight space of the air cavity 120 is increasing.

When the air pressure of the air cavity 120 recovers, the air intake force is decreasing, and finally the diffused water wall of the injected flow flows and covers the opening of the air intake ventilation hole 141*b* again.

As shown above, the fluctuation of the air blowing rhythm of the air pressure between the air decreasing state without the outer air blowing shown in the left of FIG. 10 (*b*) and the air pressure increasing state with the outer air blowing shown in the right of FIG. 10 (*b*) appear alternately. The pulsatile flow or the intermittent flow of the present invention is provided.

The air mass is pushed by the liquid mass in the draining portion 150. If the air mass exists between the former liquid mass and the latter liquid mass, the former liquid mass and the latter liquid mass become independent from each other, and the pulsatile flow or intermittent flow flows out through the draining portion 150.

Embodiment 4

The principle of the device for generating pulsatile flow or intermittent flow 100*c* of the embodiment 4 of the present invention is described below.

Figure 11:
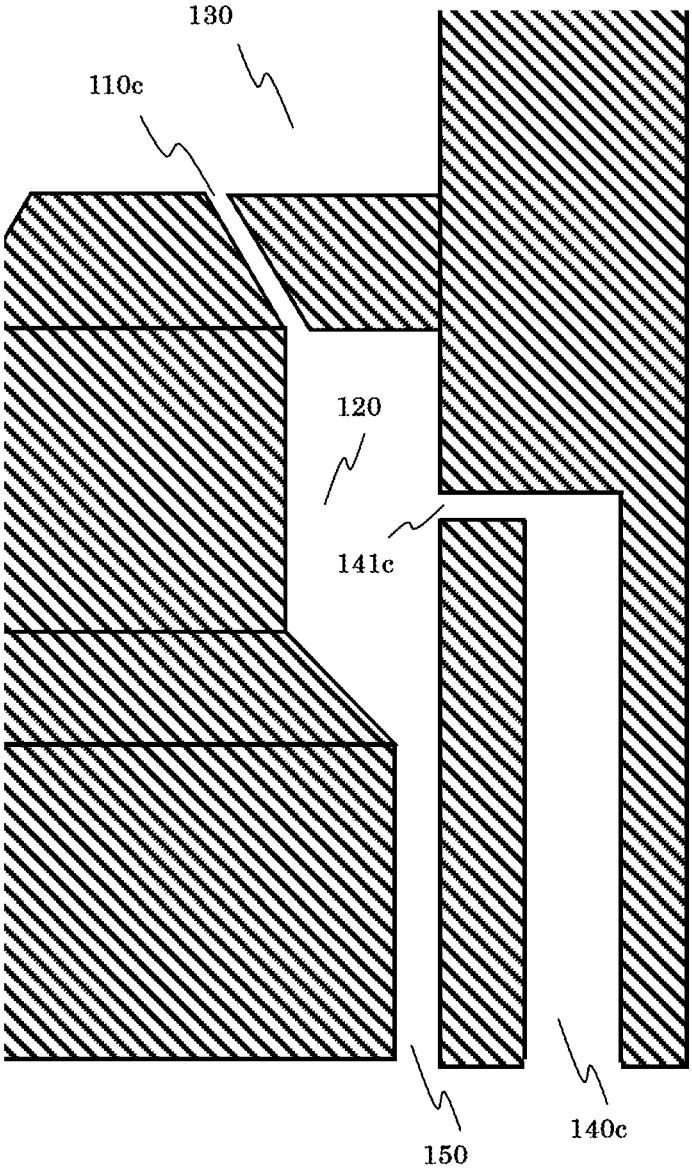
FIG. 11 is a schematic view of the device for generating the pulsatile flow or the intermittent flow 100*c* of the present invention in embodiment 4.

FIG. 11 is a schematic view of the device for generating the pulsatile flow or the intermittent flow 100*c* of the present invention in embodiment 4.

FIG. 11 shows only a part of the device for generating pulsatile flow or intermittent flow 100*c* of the embodiment 4. An injection mechanism 110*c*, an air cavity 120, an input portion 130, an air intake ventilation pass 140*c*, an air intake ventilation hole 141*c* and a draining portion 150 are shown in FIG. 11.

The air cavity 120, the input portion 130 and the draining portion 150 shown in FIG. 11 are the same configurations shown in FIG. 2. The descriptions regarding those elements are omitted here.

The injection angle of the injection mechanism 110*c* is adjusted as the angle for injecting the water flow just below the opening of the air intake ventilation hole 141*c*.

Figure 12:
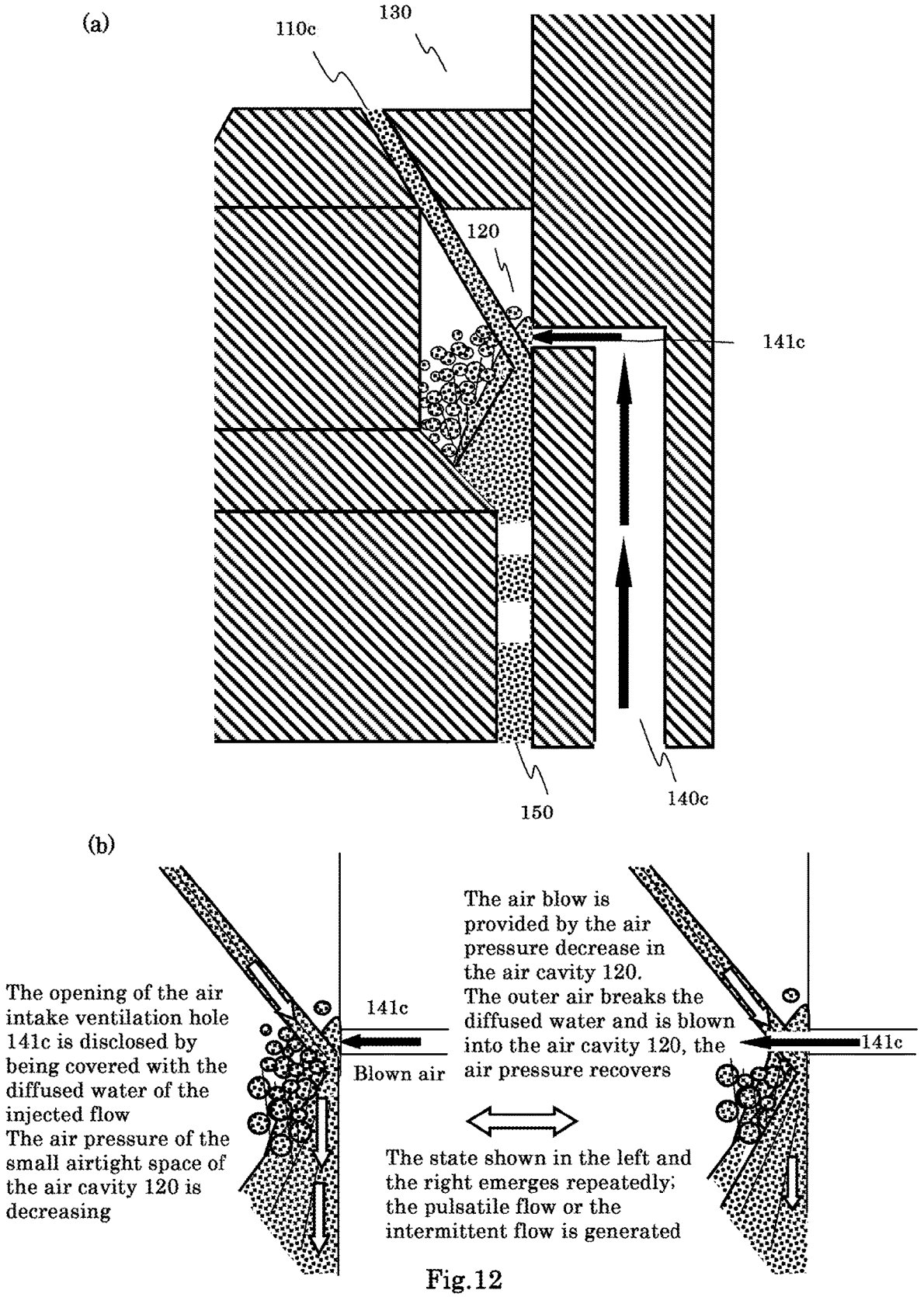
FIG. 12 is a schematic view showing the state of the device for generating the pulsatile flow or the intermittent flow 100*c* in which water flow flows.

FIG. 12 is a schematic view showing the state of the device for generating the pulsatile flow or the intermittent flow 100*c* in which water flow flows.

As shown in FIG. 12, the basic operation is the same as that of embodiment 1 in that the injected flow is injected by injection mechanism 110*c* to the inner air of the airtight space in the air cavity 120, and the injected flow assimilates the inner air and flows out via the draining portion 150.

As shown in FIG. 12, the angle of the injection mechanism 110*c* is adjusted as the angle for hitting the water flow just below the opening of the air intake ventilation hole 141*c*. The water diffusion may occur by reflecting the injected flow and covering the opening of the air ventilation hole 141*c* after hitting the side wall of the air cavity 120 depending on the condition of the side wall figure and the hit angle. The case shown in FIG. 12 satisfies such condition for water diffusion.

The opening of the air ventilation hole 141*c* is covered by a part of the diffused injected flow in FIG. 12.

The diffusion of the injected flow is designed and controlled intentionally, not by accidentally, by adjusting the angle of the injection mechanism 110*c* and the shape and configuration of the air cavity 120 for covering the opening of the air ventilation hole 141*c* with the diffused water consecutively.

The state shown in the left in FIG. 10 (*b*) is the state in which the opening of the air intake ventilation hole 141*c* is closed by being covered with the diffused water of the injected flow. In this state, the outer air is blocked by the diffused water of the injected flow momentarily, and the inner air decreases in the air cavity 120, so the air pressure of the small airtight space of the air cavity 120 is decreasing.

The fluctuation of the air pressure in the air cavity 120 is described.

As shown in the left in FIG. 12 (*b*), the air pressure of the air cavity 120 decreases because the injected flow assimilates the inner air of the air cavity 120 and outflows from the draining portion 150. It is understood that the air cavity 120 is a small airtight space, so the air pressure decreases by bringing the inner air to the outside via the draining portion 150.

There is air intake from the outer air into the air cavity 120 via the air intake ventilation hole 141*c* through the air intake ventilation pass 140*c* because the injected flow assimilates the inner air of the air cavity 120 and outflows from the draining portion 150.

This air intake is generated by the air pressure decreasing of the air cavity 120.

The state shown in the right in FIG. 12 (*b*) is the state in which the opening of the air intake ventilation hole 141*c* is opened by breaking the diffused water of the injected flow by the outer air blowing when the air intake force gets bigger to break the diffused water of the injected flow. In this state, the outer air breaks the diffused water of the injected flow momentarily, and the inner air increases in air cavity 120, so the air pressure of the small airtight space of the air cavity 120 is increasing.

When the air pressure of the air cavity 120 recovers, the air intake force is decreasing, and finally the diffused water of the injected flow flows and covers the opening of the air intake ventilation hole 141*c* again. It returns to the state shown in FIG. 12 (*b*).

As shown above, the fluctuation of the air blowing cycle of the air pressure between the air decreasing state without the outer air blowing shown in the left of FIG. 12 (*b*) and the air pressure increasing state with the outer air blowing shown in the right of FIG. 12 (*b*) appear alternately. The pulsatile flow or the intermittent flow of the present invention is provided.

The air mass is pushed by the liquid mass in the draining portion 150. If the air mass exists between the former liquid mass and the latter liquid mass, the former liquid mass and the latter liquid mass become independent from each other, and the pulsatile flow or intermittent flow flows out through the draining portion 150. This state is the same as that of FIG. 3.

There is no description about the diffusion after hitting the side wall by the injected flow in Embodiment 1, 2 and 3, and the diffusion may occur in Embodiment 1, 2 and 3 for covering the opening of the air intake ventilation hole 141. The air blowing cycle of the air pressure between the air decreasing state without the outer air blowing shown in the left of FIG. 12 (*b*) and the air pressure increasing state with the outer air blowing shown in the right of FIG. 12 (*b*) appear alternately.

Embodiment 5

The device for generating the pulsatile flow or intermittent flow of the Embodiment 5 of the present invention is that it can provide plural pulsatile flows or intermittent flows a-synchronously at random, having a wider washing area.

The pulsatile flows or the intermittent flows are generated by the device for generating pulsatile flow or intermittent flow of any one of Embodiment 1 to 4. In those examples, water is used as the flowing medium, the pulsatile flows or the intermittent flows are foamed water. For example, the pulsatile flows or the intermittent flows are foamed water masses.

The area that can obtain the washing effect by the pulsatile flows or the intermittent flows is described as the concept shown in FIG. 4 (*b*) to FIG. 4 (*f*) in which target dirt is wiped aside gradually, so the washing area is spread out gradually. However, the expansion of the washing area by single pulsatile flow or single intermittent flow is limited. The device of Embodiment 5 provides plural pulsatile flows or plural intermittent flows.

Figure 13:
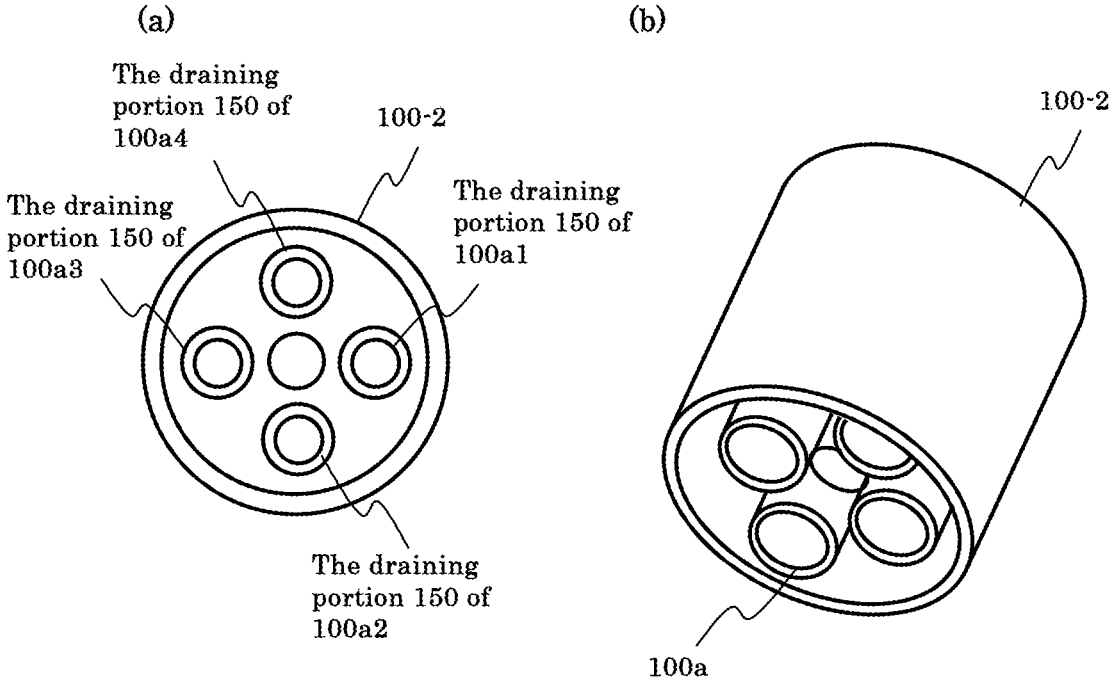
FIG. 13 is a schematic view of the device for generating the pulsatile flow or the intermittent flow 100-2 of the present invention in embodiment 5.

FIG. 13 is a schematic view of the device for generating the pulsatile flow or the intermittent flow 100-2 of the present invention in embodiment 5. Plural devices of any one shown in Embodiment 1 to 4 are combined in one body. The device for generating the pulsatile flow or the intermittent flow 100-2 outflows plural pulsatile flows or plural intermittent flows.

As shown in FIG. 13, 4 sets of the device for generating pulsatile flow or intermittent flow shown in Embodiment 2 (100*a*1 to 100*a*4) are installed in a large housing, and 4 sets of the draining portion 150 can be seen in a bottom surface.

The device for generating pulsatile flow or intermittent flow 100-2 provides 4 pulsatile flows or intermittent flows.

FIG. 14 is a schematic view showing the dirt washing effect by the device for generating the pulsatile flow or the intermittent flow 100-2.

FIG. 14 shows a moment for flowing three pulsatile flows or intermittent flows in parallel.

FIG. 14 (*a*) shows a moment for hitting the dirt on the target object by pulsatile flows or intermittent flows outflow at random. The upper drawing of the FIG. 14 (*a*) shows the moment that the center foamed water mass hits the dirt on the surface of the target. The foamed water mass hits on the dirt and crushes without reflecting as shown in FIG. 4 in Embodiment 1. The motion energy is applied to the dirt to wipe it aside, and the dirt will peel off efficiently. Next, the lower drawing of the FIG. 14 (*a*) shows the moment that the left side foamed water mass hits the dirt on the surface of the target. The foamed water mass hits on the dirt and crushes without reflecting as shown in FIG. 4 in Embodiment 1. The motion energy is applied to the dirt to wipe it aside, and the dirt will peel off efficiently.

Figure 15:
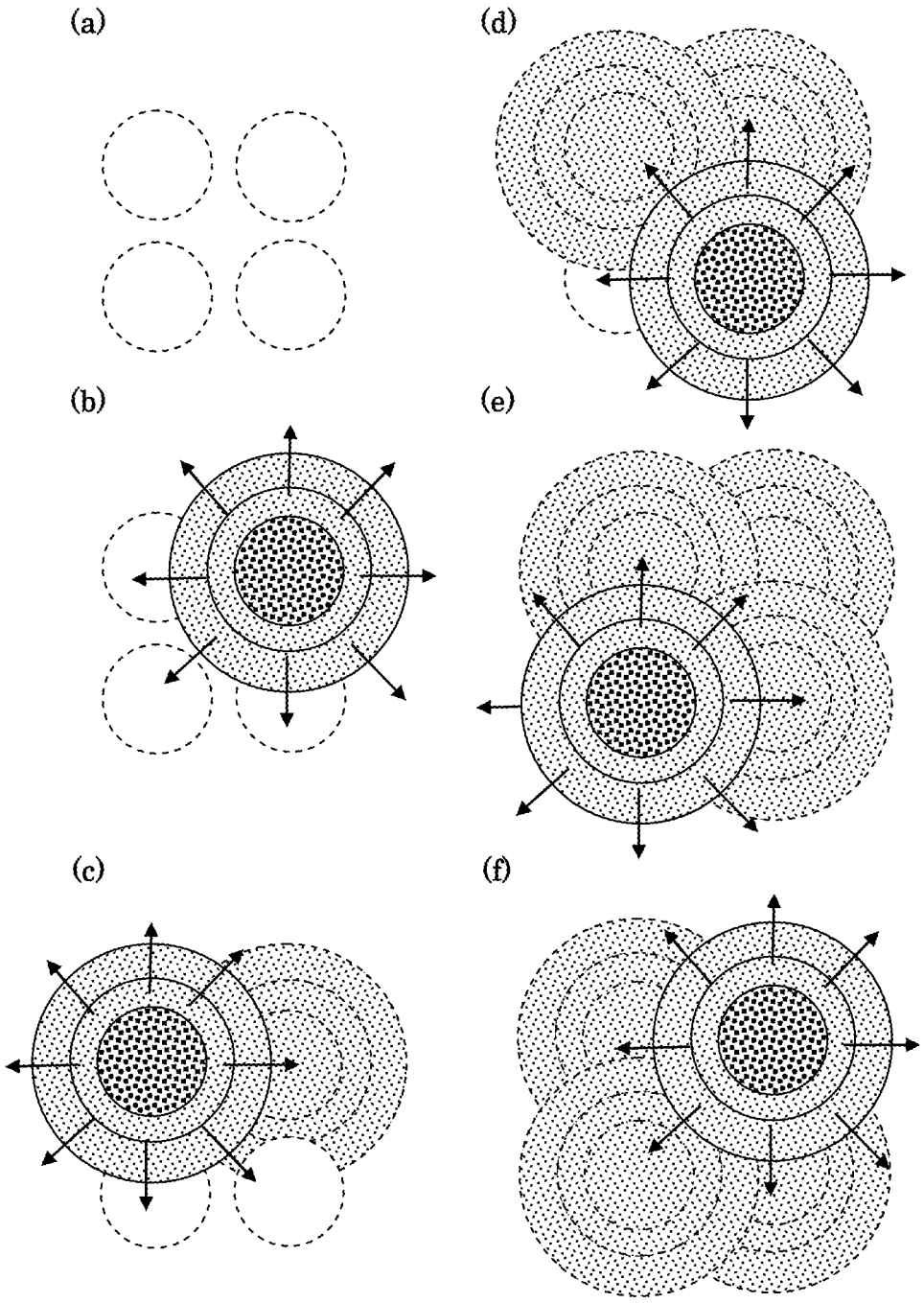
FIG. 15 is a schematic view of the status of the surface of the target object where the four pieces of the pulsatile flows or the intermittent flows hit.
Figure 16:
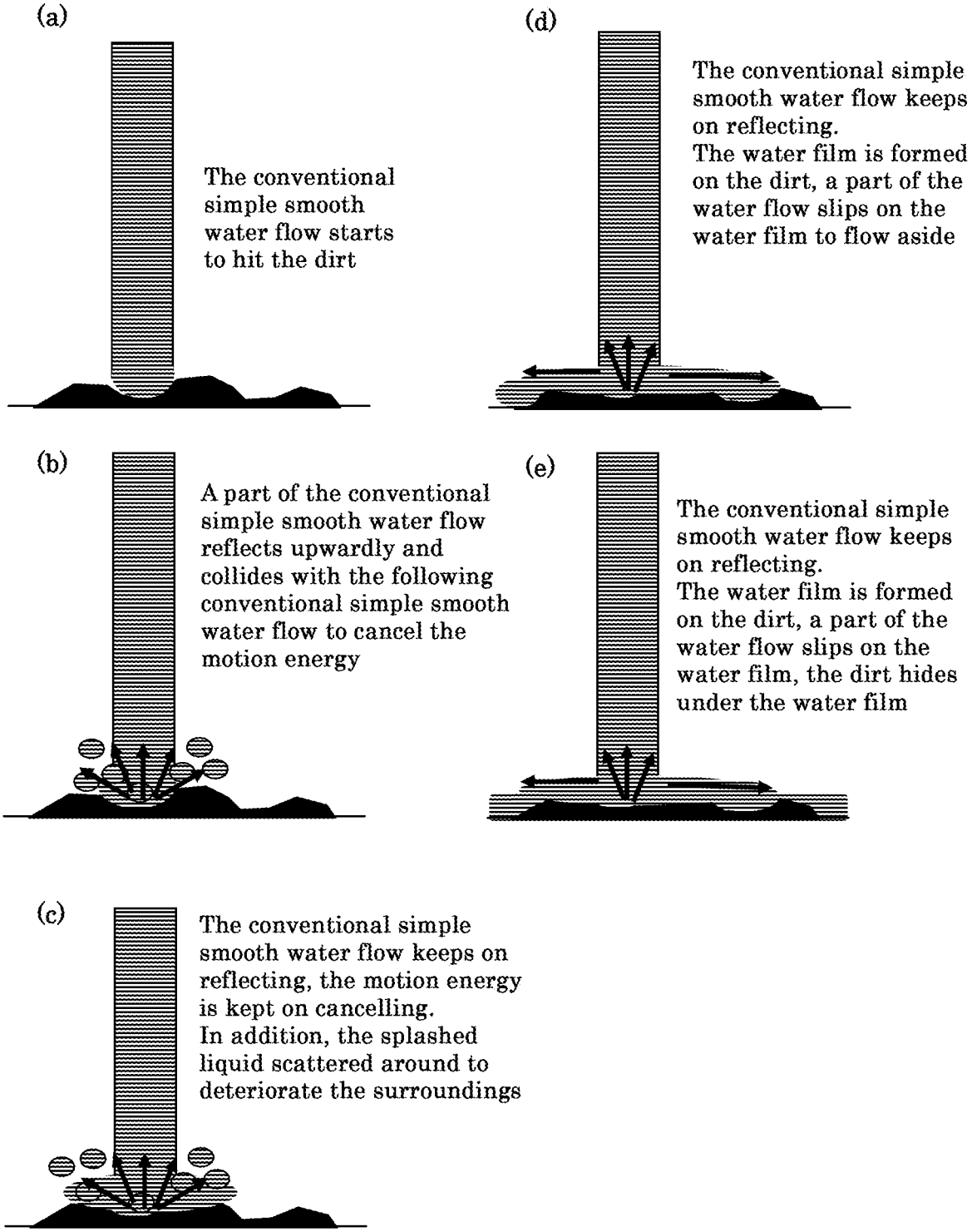
FIG. 16 is a schematic view of the conventional simple smooth water flow.

FIG. 15 is a schematic view of the status of the surface of the target object where the four pieces of the pulsatile flows or the intermittent flows hitting.

FIG. 15 (*a*) shows four circles drawn by broken lines. These indicate the center position of the hitting area of the foamed water mass.

First, the foamed water mass on the upper-right position shown in FIG. 15 (*b*) hits the dirt on the surface of the target. When the foamed water mass hits on the dirt, it crushes without reflecting as shown in FIG. 4 and FIG. 14. The motion energy is applied to the dirt to wipe it aside, and the dirt will peel off efficiently. FIG. 15 (*b*) shows the water edge spreading on the surface of the target.

Next, the foamed water mass on the upper-left position shown in FIG. 15 (*c*) hits the dirt on the surface of the target. When the foamed water mass hits on the dirt, the same as FIG. 15 (*b*), it crushes without reflecting as shown in FIG. 4 and FIG. 14. The motion energy is applied to the dirt to wipe it aside, and the dirt will peel off efficiently. FIG. 15 (*c*) shows the water edge spreading on the surface of the target.

Next, the foamed water mass on the lower-right position shown in FIG. 15 (*d*) hits the dirt on the surface of the target. Then, the foamed water mass on the lower-left position shown in FIG. 15 (*e*) hits the dirt on the surface of the target. Then, the foamed water mass on the upper-right position shown in FIG. 15 (*f*) hits the dirt on the surface of the target.

As shown above, plural foamed water masses hit on the dirt one after another, all motion energy is applied to the dirt to wipe it aside, and the washing operation continues. The hitting position fluctuates up and down and back and forth, so the dirt is wiped in relative positions. Therefore, what is called a mop up effect can be obtained as if the surface of the target object is mopped up by a rubbing cloth. The higher washing effect can be obtained by the foamed water mass in random positions versus that of the foamed water mass in a constant position because the water mop up effect can be obtained.

FIG. 14 (*b*) is a schematic view of the case in which foamed water mass flows synchronously. As shown in the upper drawing in FIG. 14 (*b*), synchronized foamed water masses come and hit on the dirt at the same time. Each foamed water mass hits on the dirt and crushes without reflecting as shown in FIG. 4 and FIG. 14 and motion energy is applied to the dirt to wipe it aside. However, all foamed water masses crush at the same time, the washing effect interferences each other, motion energy collides each other. A part of motion energy is cancelled each other.

As shown in the lower drawing in FIG. 14 (*b*), the next coming synchronized foamed water masses has not arrived yet, and the washing effect is stopped at a moment until the next coming foamed water masses hit. This state shown in FIG. 14 (*b*) depends on the gap between the former foamed water mass and the latter foamed water mass and the period for expanding the motion energy to wipe aside, as can be seen in FIG. 14 (*b*).

As shown above, plural pulsatile flows or intermittent flows are provided by employing plural sets of devices shown in Embodiment 1 to 4 and when foamed water masses are a-synchronous at random, the mop up effect can be obtained as if the surface of the target object is mopped up by the rubbing cloth.

While some preferable embodiments of the device for generating pulsatile flow or intermittent flow according to the present invention are described above, it should be understood that various changes are possible, without deviating from the technical scope according to the present invention. For example, the present invention can employ liquid other than water or gas as the injected flow.

The device of the present invention can be installed to various machines. For example, the device of the present invention can be installed to foamed aerator attached to the water tap, and the foamed aerator can provide the washing water flow having a high washing effect.

For example, the device of the present invention can be installed to a process machine. For example, the semiconductor manufacturing machine can employ the device for generating the pulsatile flow or the intermittent flow for the carrier flow required in the process for introducing the material to be processed to the reactor chamber. For example, the water jet peening for peening the surface of the structural membrane can employ the device for generating the pulsatile flow or the intermittent flow for the peening water jet.

For example, the cleaning machine and the purification machine can employ the device for generating the pulsatile flow or the intermittent flow in the cleaning process and the removing process instead of the conventional scraper. The pulsatile media flow or the intermittent media flow is used for removing the cut residue or the cullet by blowing away by the pulsatile media flow or the intermittent media flow.

For example, the measurement machine can employ the device for generating the pulsatile flow or the intermittent flow. For example, the apparatus for analyzing the influence of the pulsatile media flow or the intermittent media flow in the measurement system can employ the device of the present invention. As another example, the apparatus for measuring the influence of the pulsatile media flow or the intermittent media flow for simulation can employ the device of the present invention.

For example, the gas turbine burner, the heat accumulating radiant tube burner and the jet engine can employ the device of the present invention for generating the pulsatile gas flow or the intermittent gas flow.

For example, the medical apparatuses and the medical devices can employ the device of the present invention for generating the pulsatile flow or the intermittent flow as a liquid injector for cutting the tissues or removing the cut tissues.

The above shown machines are examples. There are various apparatus and machines employing the device of the present invention.

Therefore, the technical scope according to the present invention is limited only by the claims attached.

REFERENCE NUMBER IN THE FIGS

100 denotes a device for generating the pulsatile flow or the intermittent flow

110 denotes an aerator

111 denotes an injection mechanism
120 denotes an air cavity
140 denotes an air intake ventilation pass
141 denotes an air intake ventilation hole
150 denotes a draining portion

The invention claimed is:

1. A device for generating pulsatile flow or intermittent flow, configured to be attached to a faucet of waterway equipment or a gas valve equipment, comprising;

an injection outlet opening configured to provide an injected flow from the faucet of waterway equipment or the gas valve equipment to an air cavity provided below the injection outlet opening, wherein the air cavity includes a space, an air intake ventilation hole provided at a side wall of the air cavity connecting to an outer air, and a draining portion through which a liquid flow or gas flow flows from the air cavity; wherein the space of the air cavity is configured such that input flows to the air cavity consist of the injected flow from the injection outlet opening and an air flow from the air intake ventilation hole, and output flow from the air cavity consists of a flow from the draining portion, wherein:

(i) the injection outlet opening is configured to have an injection direction such that the injected flow in the air cavity strikes a side wall of the air cavity above where the air intake ventilation hole is provided on the side wall, such that the injected flow passes over the air intake ventilation hole with an impacting portion of the injected flow or a reflection of the injected flow after hitting the side wall of the air cavity, and the opening of the air intake ventilation hole is blocked by the injected flow; and (ii) the air cavity retains inner air in the space when the injected flow flows into the air cavity; wherein air pressure is decreased when the air intake ventilation hole is blocked, and recovered when the air intake ventilation hole is ventilated by breaking the blocking of the injected flow by an air pressure of a blown air flow through the air intake ventilation hole alternately according to a strength of the air pressure, or (iii) a part of the inner air flows out with a flow from the draining portion, the air pressure being decreased by the flow of the part of the inner air from the draining portion.

2. A device for generating pulsatile flow or intermittent flow according to claim 1, wherein an outlet of the draining portion is shaped such that the draining portion is totally covered by the injected flow, blocking air backflow from the outer air.

3. A device for generating pulsatile flow or intermittent flow according to claim 1, wherein a strength of the air pressure of the blown air flow through the air intake ventilation hole at a maximum is sufficient to break the injected flow passing the air intake ventilation hole.

4. A device for generating pulsatile flow or intermittent flow according to claim 1, further comprising an outer element for surrounding a main body in which the liquid or gas flow flows, wherein an air ventilation passage from the outer air to the air intake ventilation hole is formed.

5. A device for generating pulsatile flow or intermittent flow according to claim 1, wherein the air cavity is provided as a passage route for the injected flow and wherein input flows to the air cavity are the injected flow from the injection outlet opening and the air flow from the air intake ventilation hole, and the output flow is only the pulsatile flow or the intermittent flow from the draining portion, and there is no other input flow and output flow; and the inner air of the air cavity is maintained.

6. A device for generating pulsatile flow or intermittent flow according to claim 5, wherein the injection outlet opening includes a surrounding water flow curtain forming output comprising a gap for flushing liquid or gas flow and forming a three-dimensional surrounding liquid or gas flow curtain in which an accelerated injected flow flushes downstream from the gap, wherein the three-dimensional surrounding liquid or gas flow curtain flows nearby the air intake ventilation hole.

7. A device for generating pulsatile flow or intermittent flow according to claim 1, wherein the injected flow is water, the outer air is natural air, and the liquid flow or gas flow flowing from the draining portion is the pulsatile flow or the intermittent flow of the water mixed with the natural air.

8. A device for generating pulsatile flow or intermittent flow according to claim 1, wherein the injected flow is bactericidal liquid, the outer air is natural air, and the liquid flow or gas flow flowing from the draining portion is the pulsatile flow or the intermittent flow of the bactericidal liquid mixed with the natural air.

9. A device for generating pulsatile flow or intermittent flow according to claim 1, wherein the injected flow is gas, the outer air is natural air, and the liquid flow or gas flowing from the draining portion is the pulsatile flow or the intermittent flow of the gas mixed with the natural air.

10. A device for generating pulsatile flow or intermittent flow according to claim 1, wherein the injected flow is solvent liquid, the outer air is solute gas, and the liquid flow or gas flowing from the draining portion is the pulsatile flow or the intermittent flow of the solute gas dissolved in the solvent liquid.

11. A device for generating pulsatile flow or intermittent flow according to claim 1, wherein the injected flow is solvent gas, the outer air is solute gas, and the liquid flow or gas flowing from the draining portion is the pulsatile flow or the intermittent flow of the solute gas mixed with solvent gas.

12. A device for generating pulsatile flow or intermittent flow according to claim 1, wherein when the injected flow covers and blocks the opening of the air intake ventilation hole, the air pressure in the air cavity is decreased because the injected flow involves the inner air and flows out from the air cavity without any ventilation to air in the air cavity from the air intake ventilation hole, the opening of the air intake ventilation hole recovers the air ventilation when breaking the blocking of the injected flow by decreasing the air pressure in the air cavity, the air pressure in the air cavity recovers and the opening of the air intake ventilation hole is blocked again, so a pattern of repeating air pressure fluctuation of decreasing and recovering is generated; and a draining flow from the draining portion becomes pulsatile flow or intermittent flow by the strength of the air pressure in the air cavity during the pattern of repeating decrease and recovery of the air pressure.

13. A device for generating pulsatile flow or intermittent flow, comprising plural sets of the device for generating pulsatile flow or intermittent flow according to claim 1, wherein said devices are arrayed at predetermined intervals, and the pulsatile flow or the intermittent flow from each draining portion of the devices are not synchronized with each other.

14. A machine employing the device for generating pulsatile flow or intermittent flow according to claim 1.

15. A method for generating pulsatile flow or intermittent flow from a faucet of a waterway equipment or a gas valve equipment, comprising;

using an injector for supplying an injected flow from the faucet of the waterway equipment or the gas valve equipment to an air cavity provided below the injector, the air cavity forming a cavity space, with an air intake ventilation hole provided at a side wall of the air cavity connecting to an outer air, and a draining portion through which a draining flow of the liquid flow or gas flow flows from the air cavity;

wherein:

(i) the injector is configured to have an injection direction such that the injected flow in the air cavity strikes a side wall of the air cavity above where the air intake ventilation hole is provided on the side wall, such that the injected flow passes over the air intake ventilation hole with an impacting portion of the injected flow or a reflection of the injected flow after hitting the side wall of the air cavity, and the opening of the air intake ventilation hole is blocked by the injected flow;

(ii) the air cavity retains inner air when the injected flow flows into the air cavity;

(iii) a part of the inner air of the air cavity flows out with the flow from the draining portion; and (iv) ventilation of the air container cavity is only via the air ventilation hole during use.

16. A method for generating pulsatile flow or intermittent flow according to claim 15, wherein the injected flow covers and blocks the opening of the air intake ventilation hole, and the air pressure in the air cavity is decreased by the draining flow carrying the inner air in the flow out from the air cavity without any ventilation from the intake ventilation hole, opening of the air intake ventilation hole recovers the air ventilation when the blocking by the injected flow is broken by the air pressure decreasing in the air cavity, as the air pressure in the air cavity recovers, the opening of the air intake ventilation hole is blocked again, so a pattern of repeating air pressure fluctuation of decreasing and recovering is generated; and the draining flow from the draining portion becomes pulsatile flow or intermittent flow by the strength of the air pressure in the air cavity the pattern of the repeating decrease and recovery of the air pressure.

* * * * *